US009797634B2

(12) United States Patent
Hatomura et al.

(10) Patent No.: US 9,797,634 B2
(45) Date of Patent: Oct. 24, 2017

(54) AIR-CONDITIONING APPARATUS WITH LOW OUTSIDE AIR TEMPERATURE MODE

(75) Inventors: Takeshi Hatomura, Tokyo (JP); Koji Yamashita, Tokyo (JP); Naofumi Takenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 421 days.

(21) Appl. No.: 14/390,511

(22) PCT Filed: Apr. 27, 2012

(86) PCT No.: PCT/JP2012/002923
§ 371 (c)(1),
(2), (4) Date: Oct. 3, 2014

(87) PCT Pub. No.: WO2013/160966
PCT Pub. Date: Oct. 31, 2013

(65) Prior Publication Data
US 2015/0107290 A1 Apr. 23, 2015

(51) Int. Cl.
*F25B 30/02* (2006.01)
*F25B 13/00* (2006.01)
(Continued)

(52) U.S. Cl.
CPC ..... *F25B 30/02* (2013.01); *F25B 13/00* (2013.01); *F25B 40/00* (2013.01); *F25B 41/00* (2013.01);
(Continued)

(58) Field of Classification Search
CPC ..... F25B 43/006; F25B 2313/006; F25B 2313/02741; F25B 2313/0314;
(Continued)

(56) References Cited

U.S. PATENT DOCUMENTS 4,326,868 A * 4/1982 Ozu ..... F04C 29/042 417/284
2011/0023514 A1* 2/2011 Mitra ..... F25B 1/10 62/222

FOREIGN PATENT DOCUMENTS

JP S63-63660 U 4/1988
JP H02-17361 A 1/1990
(Continued)

OTHER PUBLICATIONS

Extended European Search Report dated Mar. 1, 2016 in the corresponding EP application No. 12874971.0.
(Continued)

*Primary Examiner* — Jonathan Bradford
(74) *Attorney, Agent, or Firm* — Posz Law Group, PLC

(57) ABSTRACT

In the case of a heating operation in which a use side heat exchanger functions as a condenser when the outside air has a predetermined low temperature, a low-outside-air-temperature heating operation start mode is executed in which, while a refrigerant, as discharged from a compressor, flows into the use side heat exchanger, the refrigerant is supplied to the injection port of the compressor via an injection pipe and a part of a refrigerant that is accumulated in an accumulator is supplied to the compressor via a connecting pipe, and thereafter a low-outside-air-temperature heating operation mode is executed in which the refrigerant, as discharged from the compressor, is supplied to the injection port of the compressor via the injection pipe while flowing into the use side heat exchanger.

8 Claims, 8 Drawing Sheets

(51) Int. Cl.
*F25B 40/00* (2006.01)
*F25B 41/00* (2006.01)

(52) U.S. Cl.
CPC .... *F25B 41/003* (2013.01); *F25B 2313/0314* (2013.01); *F25B 2313/0315* (2013.01); *F25B 2400/0403* (2013.01); *F25B 2400/0409* (2013.01); *F25B 2400/0411* (2013.01); *F25B 2400/13* (2013.01); *F25B 2600/0261* (2013.01); *F25B 2600/2501* (2013.01); *F25B 2600/2509* (2013.01); *F25B 2600/2519* (2013.01); *F25B 2700/1931* (2013.01); *F25B 2700/1933* (2013.01); *F25B 2700/2103* (2013.01); *F25B 2700/2104* (2013.01); *F25B 2700/21152* (2013.01)

(58) Field of Classification Search
CPC ..... F25B 2400/0403; F25B 2400/0409; F25B 2400/0411; F25B 2400/13; F25B 2600/2501; F25B 2600/2509
See application file for complete search history.

(56) References Cited

FOREIGN PATENT DOCUMENTS

| | | | |
|---|---|---|---|
| JP | H11-278045 | A | 10/1999 |
| JP | 2001-91023 | A | 4/2001 |
| JP | 2008-138921 | A | 6/2008 |
| JP | 2011-47545 | A | 3/2011 |

OTHER PUBLICATIONS

International Search Report of the International Searching Authority dated Jul. 3, 2012 for the corresponding international application No. PCT/JP2012/002923 (and English translation).

* cited by examiner

AIR-CONDITIONING APPARATUS WITH LOW OUTSIDE AIR TEMPERATURE MODE

CROSS REFERENCE TO RELATED APPLICATIONS

This application is a U.S. national stage application of PCT/JP2012/002923 filed on Apr. 27, 2012, the contents of which are incorporated herein by reference.

TECHNICAL FIELD

The present invention relates to air-conditioning apparatuses applicable to, for example, multi-air-conditioning apparatuses installed in buildings.

BACKGROUND

In existing air-conditioning apparatuses such as multi-air-conditioning apparatuses installed in buildings, for example, outdoor units that are installed outside the buildings and serve as heat source units and indoor units installed inside the buildings are connected by pipes to form refrigerant circuits in which refrigerants circulate. Air is heated or cooled by utilizing heat transfer or heat removal as the refrigerants travel through the refrigerant circuits, to heat or cool the air-conditioned spaces.

When a heating operation is performed at an outside air temperature below approximately −10 degrees C. by such a multi-air-conditioning apparatus installed in a building as described above, the low-temperature outside air and the refrigerant exchange heat with each other. Thus, the evaporating temperature of the refrigerant decreases, and its evaporating pressure decreases accordingly.

Consequently, the density of a refrigerant drawn by suction into a compressor decreases and the refrigerant flow rate, in turn, decreases, resulting in an insufficient heating capacity of the air-conditioning apparatus. In addition, as the density of a refrigerant drawn by suction into the compressor is low, the compression ratio is high, causing an excessive increase in the temperature of the refrigerant discharged from the compressor. Thus, problems such as deterioration of refrigerating machine oil and damage to the compressor occur.

In order to address the problems described above, an air-conditioning apparatus has been proposed (see, for example, Patent Literature 1) which is configured to inject a two-phase refrigerant into a region where an intermediate pressure is obtained in the compression process of the compressor to improve the density of a refrigerant to be compressed and thereby increase the refrigerant flow rate so that a sufficient heating capacity can be achieved when the outside air temperature is low to reduce the discharge temperature of the compressor.

The technique described in Patent Literature 1 utilizes the fact that when the saturation temperature of a high-pressure refrigerant supplied to a load side heat exchanger becomes equal to or higher than the temperature of the indoor air, heat is transferred from the high-pressure gas refrigerant to the indoor air so that the refrigerant liquefies into a two-phase refrigerant. In this case, the two-phase refrigerant is injected into a region where an intermediate pressure is obtained in the compression process of the compressor to reduce the temperature of the refrigerant discharged from the compressor.

PATENT LITERATURE

Patent Literature 1: Japanese Unexamined Patent Application Publication No. 2008-138921 (FIG. 1, FIG. 2, etc.)

When the outside air temperature is below approximately −10 degrees C., the temperature of the air-conditioned space where an indoor unit is installed also decreases correspondingly. That is, for approximately 5 to 15 minutes immediately after the start of the air-conditioning apparatus, the saturation temperature of a high-pressure refrigerant supplied to a load side heat exchanger provided in the indoor unit is lower than the indoor air temperature. Thus, in the heating operation, even if a high-pressure refrigerant is supplied to the load side heat exchanger, the high-temperature, high-pressure gas refrigerant will not be liquefied in the load side heat exchanger.

In the technique described in Patent Literature 1, therefore, when the air-conditioning apparatus operates under a low outside air temperature condition, a gas refrigerant is injected into the compressor, resulting in a reduced effect of suppressing the increase in the temperature of the refrigerant discharged from the compressor. In addition, as the outside air temperature decreases (for example, −30 degrees C. or less), the density of a refrigerant drawn by suction into the compressor decreases, resulting in an increase in the rise of the temperature of the refrigerant discharged from the compressor.

Specifically, in the technique described in Patent Literature 1, before the high-pressure refrigerant reaches a temperature equal to or higher than the indoor air temperature, the temperature of the refrigerant discharged from the compressor temporarily excessively increases to approximately 120 degrees C. or higher, causing problems of "deterioration of refrigerating machine oil" and "damage to the compressor due to wear of a slider in the compressor, which accompanies the deterioration of the refrigerating machine oil".

In the technique described in Patent Literature 1, furthermore, the adoption of a method in which the compressor is slowed down to reduce the rotation speed and thereby suppress an increase in the temperature of the refrigerant discharged from the compressor becomes a factor which hinders smooth speedup of the compressor, prolonging the time taken to achieve a sufficient heating capacity and reducing user comfort.

SUMMARY

The present invention has been made in order to overcome the foregoing problems, and it is an object of the present invention to provide an air-conditioning apparatus that suppresses an increase in the temperature of the refrigerant discharged from a compressor while suppressing a reduction in user comfort.

An air-conditioning apparatus according to the present invention has a refrigeration cycle in which a compressor, a refrigerant flow switching device, a heat source side heat exchanger, a use side expansion device, and a use side heat exchanger are connected to one another using a refrigerant pipe. The air-conditioning apparatus includes an injection pipe having its one side connected to an injection port of the compressor, and its other side connected to the refrigerant pipe between the use side expansion device and the heat source side heat exchanger, the injection pipe being configured to inject a refrigerant during a compression operation of the compressor, a refrigerant heat exchanger configured to exchange heat between the refrigerant, upon flowing through the refrigerant pipe in the refrigeration cycle, and the refrigerant, upon flowing through the injection pipe, an accumulator having its one side connected to a suction side of the compressor, and its other side connected to the refrigerant flow switching device, the accumulator being configured to store a liquid refrigerant, and a connecting pipe having its one side connected to the suction side of the compressor, and its other side connected to a bottom of the accumulator. In the case of a heating operation in which the use side heat exchanger functions as a condenser when outside air has a predetermined low temperature, a low-outside-air-temperature heating operation start mode is executed in which, while the refrigerant, as discharged from the compressor, flows into the use side heat exchanger, the refrigerant is supplied to the injection port of the compressor via the injection pipe and a part of the refrigerant, as accumulated in the accumulator, is supplied to the compressor via the connecting pipe, and thereafter a low-outside-air-temperature heating operation mode is executed in which the refrigerant, as discharged from the compressor, is supplied to the injection port of the compressor via the injection pipe while flowing into the use side heat exchanger.

In an air-conditioning apparatus according to the present invention, in the case of a heating operation in which a use side heat exchanger functions as a condenser when the outside air has a predetermined low temperature, a low-outside-air-temperature heating operation start mode is followed by a low-outside-air-temperature heating operation mode. Thus, it is possible to suppress an increase in the temperature of the refrigerant discharged from a compressor while suppressing a reduction in user comfort.

DETAILED DESCRIPTION

Embodiment 1

Embodiments of the present invention will be described hereinafter with reference to the drawings.

Figure 1:
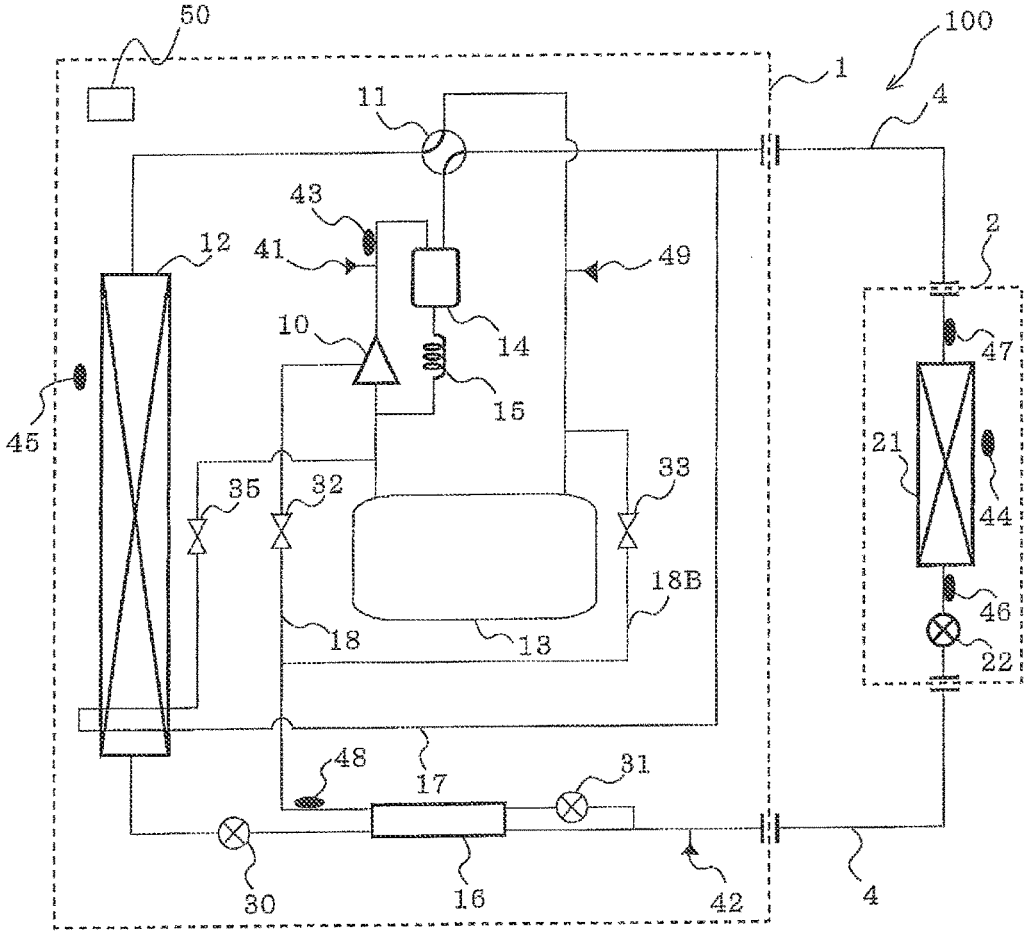
FIG. 1 is a schematic circuit configuration diagram illustrating an example of the circuit configuration of an air-conditioning apparatus according to Embodiment 1 of the present invention.

FIG. 1 is a schematic circuit configuration diagram illustrating an example of the circuit configuration of an air-conditioning apparatus (to be referred to as an air-conditioning apparatus 100 hereinafter) according to Embodiment 1. A detailed configuration of the air-conditioning apparatus 100 will be described with reference to FIG. 1. In the air-conditioning apparatus 100, an outdoor unit 1 and an indoor unit 2 are connected to each other via main refrigerant pipes 4, and a refrigerant circulates between them to allow air conditioning using a refrigeration cycle.

The air-conditioning apparatus 100 is an improved version that suppresses an increase in the temperature of the refrigerant discharged from a compressor while suppressing a reduction in user comfort, even when the outside air temperature is low.

[Outdoor Unit 1]

The outdoor unit 1 includes a compressor 10 having an injection port, a refrigerant flow switching device 11 such as a four-way valve, a heat source side heat exchanger 12, an accumulator 13 for storing a surplus refrigerant, an oil separator 14 for separating refrigerating machine oil contained in the refrigerant, an oil return pipe 15 having its one side connected to the oil separator 14 and its other side connected to the suction side of the compressor 10, a refrigerant heat exchanger 16 such as a double-pipe heat exchanger, and a first expansion device 30, and these elements are connected to one another via the main refrigerant pipes 4.

An injection pipe 18 is connected to the main refrigerant pipe 4 between the refrigerant heat exchanger 16 and the indoor unit 2 to be injected into an intermediate compression chamber in the compressor 10, and a second expansion device 31, the refrigerant heat exchanger 16, and a first opening and closing device 32 are connected in series with the injection pipe 18. A branching pipe 18B through which a refrigerant is supplied to the refrigerant inlet side of the accumulator 13 is connected to the injection pipe 18, and a second opening and closing device 33 is connected to the branching pipe 18B. The second expansion device 31 and the injection pipe 18 are disposed in the outdoor unit 1.

The outdoor unit 1 has a bypass pipe 17 for bypassing the discharge side of the compressor 10 and the suction side of the compressor 10 via the heat source side heat exchanger 12 during the heating operation. A third opening and closing device 35 for adjusting the flow rate is connected to the bypass pipe 17.

The outdoor unit 1 is provided with a first temperature sensor 43, a second temperature sensor 45, and a third temperature sensor 48 to detect the temperatures of a refrigerant, a first pressure sensor 41, a second pressure sensor 42, and a third pressure sensor 49 to detect the pressures of the refrigerant, and a controller 50 to control the rotation speed and the like of the compressor 10 based on these pieces of detected information.

The compressor 10 is configured to draw by suction and compress a refrigerant to a high-temperature, high-pressure state, and is desirably implemented using, for example, a capacity-controllable inverter compressor or the like. The compressor 10 has its discharge side connected to the refrigerant flow switching device 11 via the oil separator 14, and its suction side connected to the accumulator 13. The compressor 10 has an intermediate compression chamber, and the injection pipe 18 is connected to the intermediate compression chamber.

The refrigerant flow switching device 11 is configured to switch between the flow of refrigerant in a heating operation mode and the flow of refrigerant in a cooling operation mode. In the cooling operation mode, the refrigerant flow switching device 11 performs switching so as to connect the discharge side of the compressor 10 and the heat source side heat exchanger 12 via the oil separator 14 and connect the accumulator 13 and the indoor unit 2. In the heating operation mode, the refrigerant flow switching device 11 performs switching so as to connect the discharge side of the compressor 10 and the indoor unit 2 via the oil separator 14 and connect the heat source side heat exchanger 12 and the accumulator 13.

The heat source side heat exchanger 12 functions as an evaporator during the heating operation and functions as a condenser during the cooling operation to exchange heat between the air supplied from an air-sending device (not illustrated) such as a fan and the refrigerant. The heat source side heat exchanger 12 has its one side connected to the refrigerant flow switching device 11, and its other side connected to the first expansion device 30. The heat source side heat exchanger 12 is further connected to the bypass pipe 17 so as to exchange heat between the refrigerant supplied from the bypass pipe 17 and the air supplied from the air-sending device such as a fan.

The accumulator 13 is disposed on the suction side of the compressor 10, and is configured to accumulate a surplus refrigerant generated due to factors associated with the difference between the heating operation mode and the cooling operation mode or a surplus refrigerant generated in response to a transient change in operation. The accumulator 13 has its one side connected to the suction side of the compressor 10, and its other side connected to the refrigerant flow switching device 11.

The oil separator 14 is configured to separate a mixture of refrigerating machine oil and a refrigerant discharged from the compressor 10. The oil separator 14 is connected to the discharge side of the compressor 10, the refrigerant flow switching device 11, and the oil return pipe 15.

The oil return pipe 15 is configured to return the refrigerating machine oil to the compressor 10, and the oil return pipe 15 is preferably partially implemented using a capillary tube or the like. The oil return pipe 15 has its one side connected to the oil separator 14, and its other side connected to the suction side of the compressor 10.

The refrigerant heat exchanger 16 is configured to exchange heat between refrigerants, and is implemented using, for example, a double-pipe heat exchanger or the like. The refrigerant heat exchanger 16 sufficiently ensures the degree of subcooling of the high-pressure refrigerant during the cooling operation, and is configured to adjust the quality of the refrigerant that is to flow into the injection port of the compressor 10 during a low-outside-air-temperature heating operation. The refrigerant heat exchanger 16 has its one refrigerant passage side connected to the main refrigerant pipe 4 connecting the first expansion device 30 and the indoor unit 2, and its other refrigerant passage side connected to the injection pipe 18.

The first expansion device 30 is configured to adjust the pressure of the refrigerant that is to flow into the heat source side heat exchanger 12 in the heating operation mode. The first expansion device 30 has its one side connected to the refrigerant heat exchanger 16, and its other side connected to the heat source side heat exchanger 12.

The second expansion device 31 is configured to adjust the pressure of the refrigerant that is to flow into the injection port of the compressor 10 during the low-outside-air-temperature heating operation. The second expansion device 31 has its one side connected to the main refrigerant pipe 4 connecting the refrigerant heat exchanger 16 and the indoor unit 2, and its other side connected to the refrigerant heat exchanger 16.

The first expansion device 30 and the second expansion device 31 each function as a pressure reducing valve or an expansion valve to reduce the pressure of a refrigerant to expand it. Each of the first expansion device 30 and the second expansion device 31 is preferably implemented using a device having a variably controllable opening degree, such as an electronic expansion valve.

The injection pipe 18 is configured to connect the main refrigerant pipe 4 connecting the indoor unit 2 and the refrigerant heat exchanger 16 to the compressor 10. The injection pipe 18 is connected to the branching pipe 18B. The branching pipe 18B is provided with the second opening and closing device 33, and has its one side connected to the main refrigerant pipe 4 on the refrigerant inlet side of the accumulator 13, and its other side connected to the injection pipe 18.

The injection pipe 18 is provided with the first opening and closing device 32 to adjust the flow rate. The first opening and closing device 32 is configured to adjust the amount of refrigerant that is to flow into the injection port of the compressor 10, and the second opening and closing device 33 is configured to adjust the amount of refrigerant to be supplied to the inlet side of the accumulator 13.

The injection pipe 18, the refrigerant heat exchanger 16, the second expansion device 31, the first opening and closing device 32, and the second opening and closing device 33 allow the air-conditioning apparatus 100 to "adjust the amount of refrigerant that is to flow into the injection port of the compressor 10 from the refrigerant heat exchanger 16 during the low-outside-air-temperature heating operation", and further allow the air-conditioning apparatus 100 to "adjust the flow rate of the low-pressure refrigerant, ensure a desired degree of subcooling of the high-pressure refrigerant, and bypass the refrigerant to the inlet side of the accumulator 13 during the cooling operation".

The bypass pipe 17 is connected so as to bypass the discharge side of the compressor 10 and the suction side of the compressor 10 via the heat source side heat exchanger 12 during the heating operation. More specifically, the bypass pipe 17 has its one side connected to the main refrigerant pipe 4 connecting the refrigerant flow switching device 11 and the indoor unit 2, and its other side connected to the main refrigerant pipe 4 connecting the accumulator 13 and the suction side of the compressor 10. The bypass pipe 17 is provided to extend through the heat source side heat exchanger 12 so as to allow it to exchange heat with the refrigerant flowing through the heat source side heat exchanger 12.

The bypass pipe 17 is provided with the third opening and closing device 35 to adjust the amount of refrigerant. The third opening and closing device 35 is configured to adjust the flow of a high-pressure liquid having exchanged heat with the refrigerant flowing through the heat source side heat exchanger 12, or a two-phase refrigerant, which is supplied to the suction side of the compressor 10.

Each of the first opening and closing device 32, the second opening and closing device 33, and the third opening and closing device 35 is preferably implemented using a device capable of adjusting the opening degree of a refrigerant passage, such as, for example, a two-way valve, a solenoid valve, or an electronic expansion valve.

The first temperature sensor 43 is disposed in the main refrigerant pipe 4 connecting between the discharge side of the compressor 10 and the oil separator 14, and is configured to detect the temperature of the refrigerant discharged from the compressor 10. The second temperature sensor 45 is disposed in an air suction unit of the heat source side heat exchanger 12, and is configured to measure the ambient air temperature of the outdoor unit 1. The third temperature sensor 48 is disposed in the injection pipe 18 connecting between the refrigerant heat exchanger 16 and the first opening and closing device 32, and is configured to detect the temperature of the refrigerant that has flowed into the injection pipe 18 and that has flowed out of the refrigerant heat exchanger 16 via the second expansion device 31. Each of the first temperature sensor 43, the second temperature sensor 45, and the third temperature sensor 48 is preferably implemented using, for example, a thermistor or the like.

The first pressure sensor 41 is disposed in the main refrigerant pipe 4 connecting between the compressor 10 and the oil separator 14, and is configured to detect the pressure of the high-temperature, high-pressure refrigerant compressed by and discharged from the compressor 10. The second pressure sensor 42 is disposed in the main refrigerant pipe 4 connecting the indoor unit 2 and the refrigerant heat exchanger 16, and is configured to detect the pressure of a low-temperature, intermediate-pressure refrigerant that flows into the first expansion device 30. The third pressure sensor 49 is disposed in the main refrigerant pipe 4 connecting the refrigerant flow switching device 11 and the accumulator 13, and is configured to detect the pressure of the low-pressure refrigerant.

The controller 50 is configured to control the overall operation of the air-conditioning apparatus 100, and is implemented using a microcomputer or the like. The controller 50 controls, in accordance with pieces of information detected by various detecting means and an instruction issued by remote control, the driving frequency of the compressor 10, the rotation speeds (including ON/OFF) of fans (not illustrated) used for the heat source side heat exchanger 12 and the use side heat exchanger 21, the switching operation of the refrigerant flow switching device 11, the opening degree of the first expansion device 30, the opening degree of the second expansion device 31, the opening degree of a third expansion device 22, the opening/closing of the first opening and closing device 32, the opening/closing of the second opening and closing device 33, the opening/closing of the third opening and closing device 35, and so forth to execute operation modes (to be described later). The controller 50 may be provided for each unit, or may be provided in either the outdoor unit 1 or the indoor unit 2.

[Indoor Unit 2]

The indoor unit 2 is equipped with a use side heat exchanger 21 and a third expansion device 22. The indoor unit 2 is further provided with a fourth temperature sensor 46, a fifth temperature sensor 47, and a sixth temperature sensor 44 to detect the temperatures of a refrigerant.

The use side heat exchanger 21 is connected to the outdoor unit 1 via the main refrigerant pipes 4 so that a refrigerant flows into or out of it. The use side heat exchanger 21 is configured to exchange heat between, for example, the air supplied from an air-sending device (not illustrated) such as a fan and the refrigerant to generate air for use in heating or air for use in cooling which is supplied to an indoor space.

The third expansion device 22 functions as a pressure reducing valve or an expansion valve to reduce the pressure of a refrigerant to expand it, and is disposed on the upstream side of the use side heat exchanger 21 in the flow of a refrigerant in the cooling operation mode. The third expansion device 22 is preferably implemented using a device having a variably controllable opening degree, such as an electronic expansion valve.

The fourth temperature sensor 46 is disposed in a pipe connecting between the third expansion device 22 and the use side heat exchanger 21, and the fifth temperature sensor 47 is disposed in a pipe connecting the use side heat exchanger 21 and the refrigerant flow switching device 11. The fourth temperature sensor 46 and the fifth temperature sensor 47 are configured to detect the temperature of a refrigerant that flows into the use side heat exchanger 21 or the temperature of a refrigerant that has flowed out of the use side heat exchanger 21. The sixth temperature sensor 44 is disposed in an air suction unit of the use side heat exchanger 21. Each of the fourth temperature sensor 46, the fifth temperature sensor 47, and the sixth temperature sensor 44 is preferably implemented using, for example, a thermistor or the like.

Although FIG. 1 illustrates the air-conditioning apparatus 100 that is provided with one indoor unit 2, the embodiments herein are not limited to this configuration. That is, the air-conditioning apparatus 100 is provided with a plurality of indoor units 2 connected in parallel to the outdoor unit 1, and is capable of selecting a "cooling operation mode in which all the indoor units 2 perform a cooling operation" or a "heating operation mode in which all the indoor units 2 perform a heating operation" (both will be described later).

The individual operation modes to be executed by the air-conditioning apparatus 100 will be described below. The air-conditioning apparatus 100 implements the cooling operation mode or the heating operation mode in accordance with an instruction from the indoor unit 2. The individual operation modes will be described hereinafter in conjunction with the flow of a refrigerant.

[Cooling Operation Mode]

Figure 2:
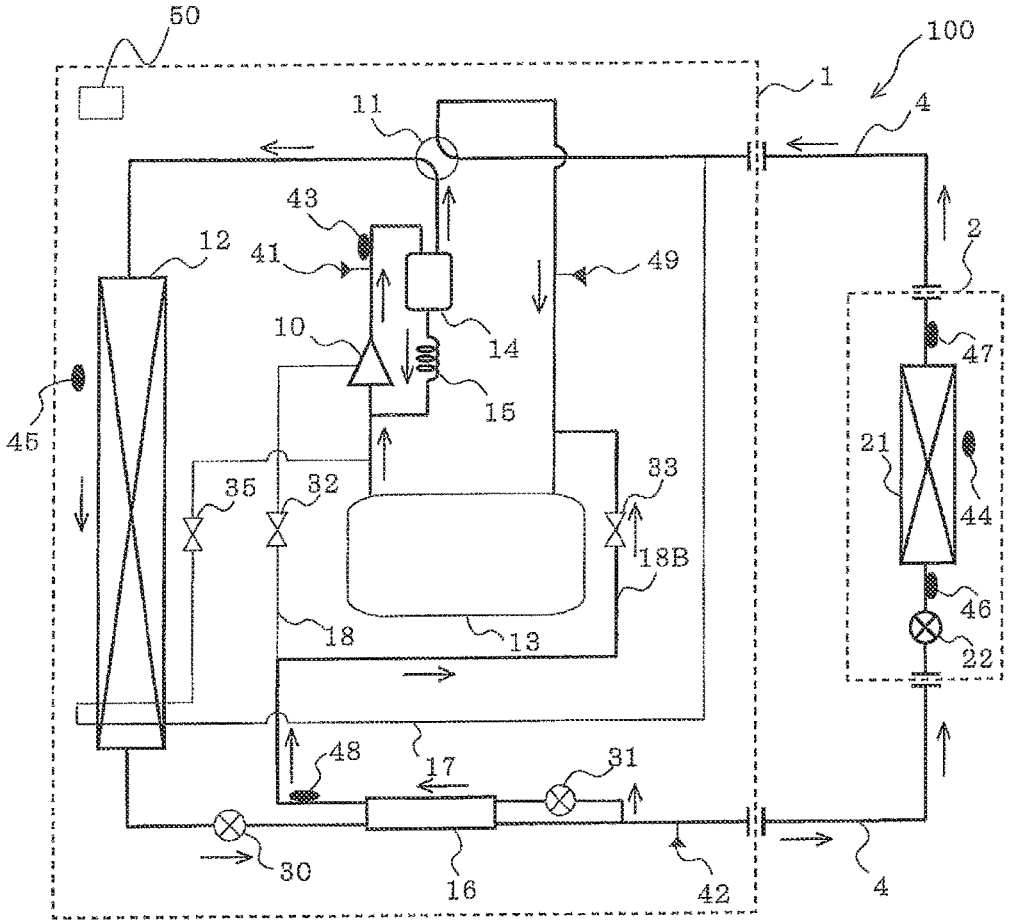
FIG. 2 is a refrigerant circuit diagram illustrating the flow of a refrigerant in a cooling operation mode of the air-conditioning apparatus according to Embodiment 1 of the present invention.

FIG. 2 is a refrigerant circuit diagram illustrating the flow of a refrigerant in a cooling operation mode of the air-conditioning apparatus 100 according to Embodiment 1. The cooling operation mode will be described with reference to FIG. 2, assuming, for example, that a cooling load has been generated in the use side heat exchanger 21. Referring to FIG. 2, the direction in which a refrigerant flows is indicated by solid arrows.

In the cooling operation mode illustrated in FIG. 2, a low-temperature, low-pressure refrigerant is compressed by the compressor 10 into a high-temperature, high-pressure gas refrigerant, which is then discharged. The high-temperature, high-pressure gas refrigerant discharged from the compressor 10 is separated by the oil separator 14 into a high-temperature, high-pressure gas refrigerant and refrigerating machine oil, and only the high-temperature, high-pressure gas refrigerant flows into the heat source side heat exchanger 12 via the refrigerant flow switching device 11. The refrigerating machine oil separated by the oil separator 14 flows into the compressor 10 from its suction side via the oil return pipe 15.

The high-temperature, high-pressure gas refrigerant that flows into the heat source side heat exchanger 12 becomes a high-pressure liquid refrigerant while transferring heat to the outdoor air from the heat source side heat exchanger 12. The high-pressure refrigerant flowing out of the heat source side heat exchanger 12 flows into the refrigerant heat exchanger 16 via the first expansion device 30, which is open to a nearly maximum degree. Then, the high-pressure refrigerant branches at the outlet of the refrigerant heat exchanger 16 into a high-pressure liquid refrigerant that flows out of the outdoor unit 1 and a high-pressure liquid refrigerant that flows into the second expansion device 31.

Note that the high-pressure liquid refrigerant that flows out of the outdoor unit 1 transfers heat in the refrigerant heat exchanger 16 to a low-pressure, low-temperature refrigerant decompressed by the second expansion device 31, and becomes a subcooled high-pressure liquid refrigerant as a result.

On the other hand, the high-pressure liquid refrigerant that flows into the second expansion device 31 is decompressed to a low-pressure, low-temperature refrigerant by the second expansion device 31, then removes heat in the refrigerant heat exchanger 16 from the high-pressure liquid refrigerant flowing out of the first expansion device 30, and becomes a low-pressure gas refrigerant as a result. The low-pressure gas refrigerant flows into the accumulator 13 via the second opening and closing device 33. Since the first opening and closing device 32 is closed, the refrigerant is not injected into the compressor 10.

The high-pressure liquid refrigerant flowing out of the outdoor unit 1 passes through the main refrigerant pipe 4, and is expanded into a low-temperature, low-pressure two-phase refrigerant by the third expansion device 22. The two-phase refrigerant flows into the use side heat exchanger 21 operating as an evaporator, removes heat from the indoor air, and, as a result, becomes a low-temperature, low-pressure gas refrigerant while cooling the indoor air. The gas refrigerant flowing out of the use side heat exchanger 21 passes through the main refrigerant pipe 4, and flows into the outdoor unit 1 again. The refrigerant flowing into the outdoor unit 1 passes through the refrigerant flow switching device 11 and the accumulator 13, and is drawn by suction into the compressor 10 again.

Note that the opening degree of the second expansion device 31 is controlled so that the degree of superheat, which is obtained as the difference between the refrigerant saturation temperature calculated from the pressure detected by the third pressure sensor 49 and the temperature detected by the third temperature sensor 48, becomes constant. Furthermore, the opening degree of the third expansion device 22 is controlled so that the degree of superheat, which is obtained as the difference between the temperature detected by the fourth temperature sensor 46 and the temperature detected by the fifth temperature sensor 47, becomes constant.

[Heating Operation Mode]

Figure 3:
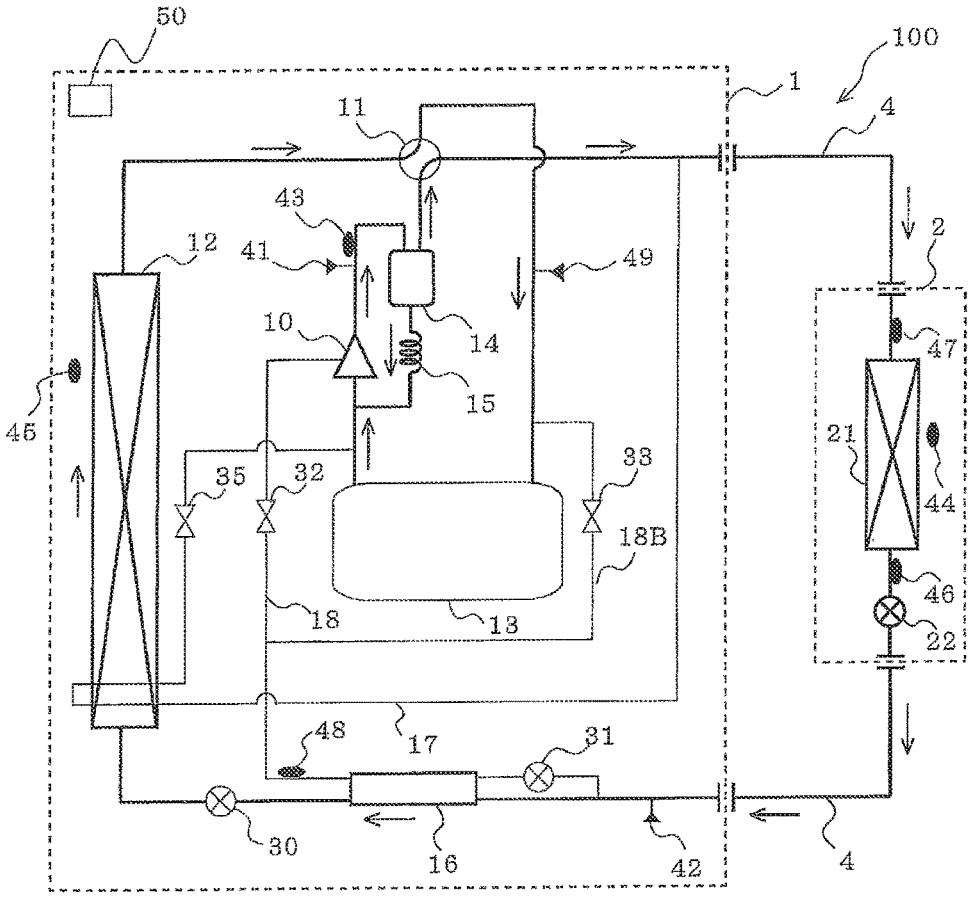
FIG. 3 is a refrigerant circuit diagram illustrating the flow of a refrigerant in a heating operation mode of the air-conditioning apparatus according to Embodiment 1 of the present invention.

FIG. 3 is a refrigerant circuit diagram illustrating the flow of a refrigerant in a heating operation mode of the air-conditioning apparatus 100 according to Embodiment 1. This heating operation mode is executed when the outside air temperature is comparatively high (for example, 5 degrees C. or higher). Referring to FIG. 3, the direction in which a refrigerant flows is indicated by solid arrows.

In the heating operation mode illustrated in FIG. 3, a low-temperature, low-pressure refrigerant is compressed by the compressor 10 into a high-temperature, high-pressure gas refrigerant, which is then discharged. The high-temperature, high-pressure gas refrigerant discharged from the compressor 10 is separated by the oil separator 14 into a high-temperature, high-pressure gas refrigerant and refrigerating machine oil, and only the high-temperature, high-pressure gas refrigerant flows out of the outdoor unit 1 via the refrigerant flow switching device 11. The refrigerating machine oil separated by the oil separator 14 flows into the compressor 10 from its suction side via the oil return pipe 15.

The high-temperature, high-pressure gas refrigerant flowing out of the outdoor unit 1 passes through the main refrigerant pipe 4, transfers heat in the use side heat exchanger 21 to the indoor air, and, as a result, becomes a liquid refrigerant while heating the indoor air. The liquid refrigerant flowing out of the use side heat exchanger 21 is expanded by the third expansion device 22 into a low-temperature, intermediate-pressure two-phase or liquid refrigerant, which passes through the main refrigerant pipe 4 and flows into the outdoor unit 1 again.

The low-temperature, intermediate-pressure two-phase or liquid refrigerant flowing into the outdoor unit 1 passes through the refrigerant heat exchanger 16 without heat exchange, and becomes a low-temperature, low-pressure gas refrigerant while removing heat in the heat source side heat exchanger 12 from the outdoor air via the first expansion device 30, which is open to a nearly maximum degree. The low-temperature, low-pressure gas refrigerant is drawn by suction into the compressor 10 again via the refrigerant flow switching device 11 and the accumulator 13.

In a normal heating operation mode, the second expansion device 31 is closed. Furthermore, the opening degree of the third expansion device 22 is controlled so that the degree of subcooling, which is obtained as the difference between the value of the saturation temperature corresponding to the pressure detected by the first pressure sensor 41 and the temperature detected by the fourth temperature sensor 46, becomes constant.

[Low-Outside-Air-Temperature Heating Operation Mode]

Figure 4:
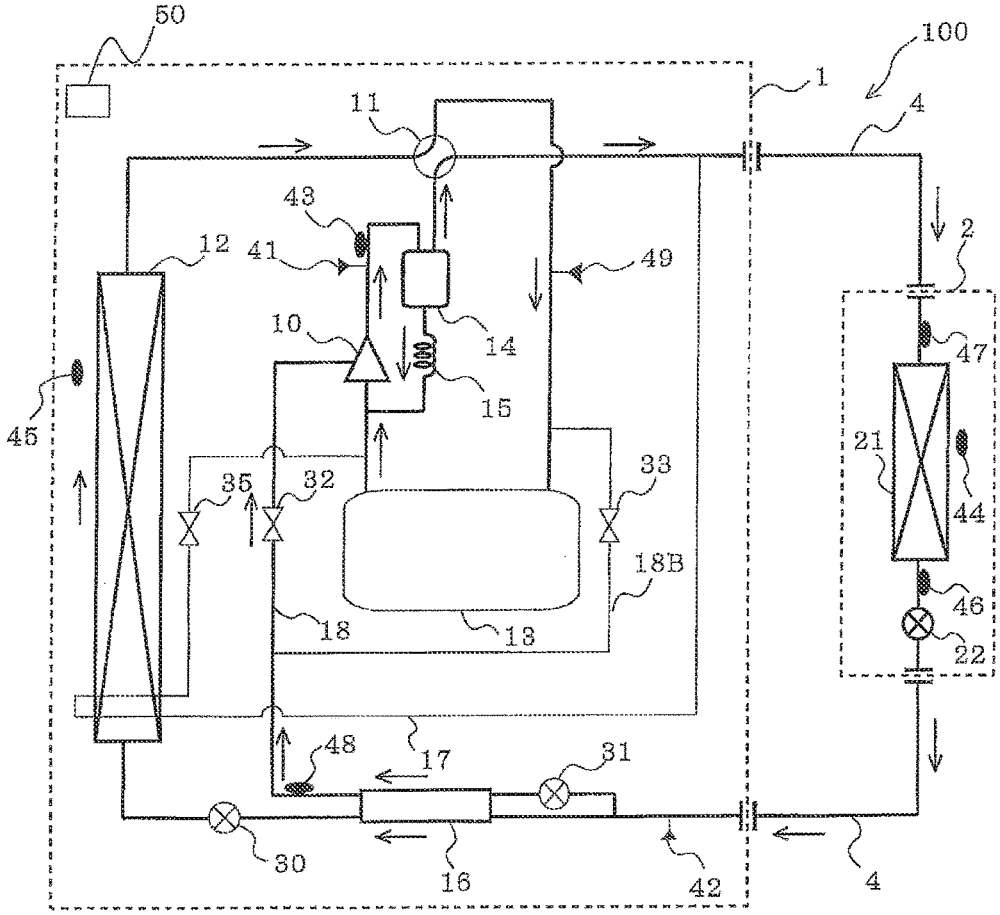
FIG. 4 is a refrigerant circuit diagram illustrating the flow of a refrigerant in a low-outside-air-temperature heating operation mode of the air-conditioning apparatus according to Embodiment 1 of the present invention.

FIG. 4 is a refrigerant circuit diagram illustrating the flow of a refrigerant in a low-outside-air-temperature heating operation mode of the air-conditioning apparatus 100 according to Embodiment 1. The low-outside-air-temperature heating operation mode is executed when the outside air temperature is comparatively low (for example, −10 degrees C. or less). Referring to FIG. 4, the direction in which a refrigerant flows is indicated by solid arrows.

In the low-outside-air-temperature heating operation mode illustrated in FIG. 4, a low-temperature, low-pressure refrigerant is compressed by the compressor 10 into a high-temperature, high-pressure gas refrigerant, which is then discharged. The high-temperature, high-pressure gas refrigerant discharged from the compressor 10 is separated by the oil separator 14 into a high-temperature, high-pressure gas refrigerant and refrigerating machine oil, and only the high-temperature, high-pressure gas refrigerant flows out of the outdoor unit 1 via the refrigerant flow switching device 11. The refrigerating machine oil separated by the oil separator 14 flows into the compressor 10 from its suction side via the oil return pipe 15.

The high-temperature, high-pressure gas refrigerant that has flowed out of the outdoor unit 1 passes through the main refrigerant pipe 4, transfers heat in the use side heat exchanger 21 to the indoor air, and, as a result, becomes a liquid refrigerant while heating the indoor air. The liquid refrigerant flowing out of the use side heat exchanger 21 is expanded by the third expansion device 22 into a low-temperature, intermediate-pressure two-phase or liquid refrigerant, which passes through the main refrigerant pipe 4 and flows into the outdoor unit 1 again. The low-temperature, intermediate-pressure two-phase or liquid refrigerant flowing into the outdoor unit 1 branches at the inlet of the refrigerant heat exchanger 16 into a refrigerant that flows into the refrigerant heat exchanger 16 and a refrigerant that flows into the injection pipe 18.

The refrigerant that has flowed into the refrigerant heat exchanger 16 on the side of the main refrigerant pipe 4 transfers heat to the refrigerant on the side of the injection pipe 18, which is a low-temperature, low-pressure two-phase refrigerant decompressed by the second expansion device 31, so as to be further cooled into a low-temperature, intermediate-pressure liquid refrigerant. Then, the low-temperature, intermediate-pressure liquid refrigerant further cooled in the refrigerant heat exchanger 16 flows into and is decompressed by the first expansion device 30, and then becomes a low-temperature, low-pressure gas refrigerant while removing heat in the heat source side heat exchanger 12 from the outdoor air. The low-temperature, low-pressure gas refrigerant flowing out of the heat source side heat exchanger 12 is drawn by suction into the compressor 10 again via the refrigerant flow switching device 11 and the accumulator 13.

On the other hand, the refrigerant that has flowed into the injection pipe 18 flows into and is decompressed by the second expansion device 31 into a low-temperature, low-pressure two-phase refrigerant. The low-temperature, low-pressure two-phase refrigerant then flows into the refrigerant heat exchanger 16, removes heat from the low-temperature, intermediate-pressure two-phase or liquid refrigerant, and, as a result, becomes a low-temperature, low-pressure two-phase refrigerant having a slightly high quality and having a pressure higher than the intermediate pressure of the compressor 10. The low-temperature, low-pressure two-phase refrigerant flowing out of the refrigerant heat exchanger 16 on the side of the injection pipe 18 is injected into the intermediate compression chamber in the compressor 10 via the first opening and closing device 32.

Note that the opening degree of the first expansion device 30 is controlled so that the pressure detected by the second pressure sensor 42 becomes equal to a predetermined value (for example, approximately 1.0 MPa). The opening degree of the second expansion device 31 is controlled so that the degree of superheat, which is obtained as the difference between the value of the saturation temperature corresponding to the pressure detected by the first pressure sensor 41 and the temperature detected by the first temperature sensor 43, becomes constant. The opening degree of the third expansion device 22 is controlled so that the degree of subcooling, which is obtained as the difference between the value of the saturation temperature corresponding to the pressure detected by the first pressure sensor 41 and the temperature detected by the fourth temperature sensor 46, becomes constant.

[Effect of Low-Outside-Air-Temperature Heating Operation Mode]

Without injection into the compressor 10, the refrigerant needs to remove heat from the low-temperature outside air in the heat source side heat exchanger 12, and its evaporating temperature therefore reduces. Thus, the density of a refrigerant drawn by suction into the compressor 10 decreases.

If the density of a refrigerant drawn by suction into the compressor 10 decreases, the flow rate of the refrigerant in the refrigeration cycle decreases, making it difficult to ensure a sufficient heating capacity. Again, if the density of a refrigerant drawn by suction into the compressor 10 decreases, a dilute refrigerant is compressed and heated. Accordingly, the temperature of the refrigerant discharged from the compressor 10 significantly increases.

However, the air-conditioning apparatus 100 executes the low-outside-air-temperature heating operation mode after executing a low-outside-air-temperature heating operation start mode (to be described later), so that the reduction in the density of a refrigerant can reliably be suppressed to ensure a sufficient heating capacity and suppress an increase in the temperature of the discharged refrigerant.

In the low-outside-air-temperature heating operation mode, the refrigerant that has removed heat in the heat source side heat exchanger 12 and turned into a low-temperature, low-pressure gas refrigerant flows into the compressor 10 via the accumulator 13. Then, the low-temperature, low-pressure gas refrigerant is compressed to an intermediate pressure by the compressor 10 and is heated, and is subsequently fed into the intermediate compression chamber. On the other hand, a two-phase refrigerant flows into the intermediate compression chamber in the compressor 10 via the injection pipe 18.

That is, the refrigerant compressed to an intermediate pressure by the compressor 10 and the two-phase refrigerant that has flowed into the compressor 10 via the injection pipe 18 merge.

Hence, as the refrigerant compressed to an intermediate pressure by the compressor 10 merges with a refrigerant to be injected, the resultant refrigerant is compressed to a high pressure, while the refrigerant temperature is lower than that before injection, and is then discharged. In the air-conditioning apparatus 100, therefore, since the temperature of the refrigerant discharged from the compressor 10 is lower than that before injection, it is possible to suppress an abnormal increase in the temperature of the refrigerant discharged from the compressor 10.

Furthermore, the refrigerant compressed to an intermediate pressure by the compressor 10 has passed through the heat source side heat exchanger 12, and is therefore a low-temperature, low-pressure gas refrigerant that has removed heat in the heat source side heat exchanger 12. In contrast, the refrigerant to be injected is a high-density two-phase refrigerant because it has not passed through the heat source side heat exchanger 12. Accordingly, injection can increase the density of a refrigerant compressed to an intermediate pressure by the compressor 10 to increase the flow rate of the refrigerant in the refrigeration cycle, thereby ensuring a sufficient heating capacity even under a low outside air temperature condition.

[Low-Outside-Air-Temperature Heating Operation Start Mode]

Figure 5:
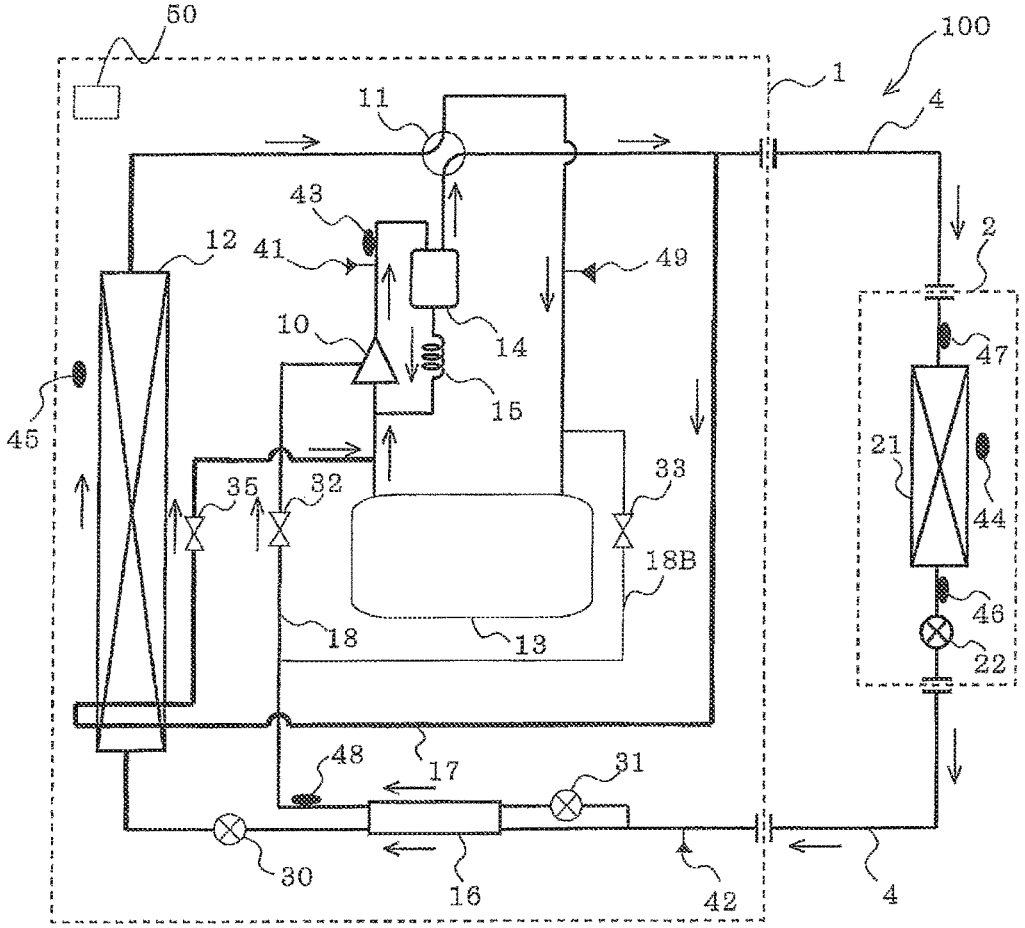
FIG. 5 is a refrigerant circuit diagram illustrating the flow of a refrigerant in a low-outside-air-temperature heating operation start mode of the air-conditioning apparatus according to Embodiment 1 of the present invention.

FIG. 5 is a refrigerant circuit diagram illustrating the flow of a refrigerant in a low-outside-air-temperature heating operation start mode of the air-conditioning apparatus 100 according to Embodiment 1. The low-outside-air-temperature heating operation mode is executed when the outside air temperature is comparatively low (for example, −10 degrees C. or less). Referring to FIG. 5, the direction in which a refrigerant flows is indicated by solid arrows.

The low-outside-air-temperature heating operation start mode is an operation mode executed prior to execution of the low-outside-air-temperature heating operation mode illustrated in FIG. 4 described above. That is, the low-outside-air-temperature heating operation start mode is followed by the low-outside-air-temperature heating operation mode described above.

In the low-outside-air-temperature heating operation start mode illustrated in FIG. 5, a low-temperature, low-pressure refrigerant is compressed by the compressor 10 into a high-temperature, high-pressure gas refrigerant, which is then discharged. The high-temperature, high-pressure gas refrigerant discharged from the compressor 10 is separated by the oil separator 14 into a high-temperature, high-pressure gas refrigerant and refrigerating machine oil, and only the high-temperature, high-pressure gas refrigerant flows into the refrigerant flow switching device 11. The refrigerating machine oil separated by the oil separator 14 flows into a suction pipe of the compressor 10 via the oil return pipe 15.

Part of the high-temperature, high-pressure gas refrigerant that has flowed out of the refrigerant flow switching device 11 flows into the bypass pipe 17, and the remainder of the gas refrigerant flows out of the outdoor unit 1.

The high-temperature, high-pressure gas refrigerant that has flowed into the bypass pipe 17 flows into the heat source side heat exchanger 12, transfers heat to the outdoor air, and becomes a low-temperature, high-pressure liquid refrigerant as a result. The low-temperature, high-pressure liquid refrigerant then flows into the compressor 10 from its suction side via the third opening and closing device 35.

The remainder of the high-temperature, high-pressure gas refrigerant that has flowed out of the refrigerant flow switching device 11 passes through the main refrigerant pipe 4, and flows into the use side heat exchanger 21. Note that if the saturation temperature of the high-temperature, high-pressure gas refrigerant that has flowed into the use side heat exchanger 21 is higher than the temperature of the indoor air, the inflow of refrigerant transfers heat to the indoor air and becomes a liquid refrigerant while heating the indoor air. If the saturation temperature of the high-temperature, high-pressure gas refrigerant that has flowed into the use side heat exchanger 21 is lower than the temperature of the indoor air, the inflow of refrigerant removes heat from the indoor air and becomes a gas refrigerant whose temperature has increased.

The refrigerant that has flowed out of the use side heat exchanger 21 is expanded by the third expansion device 22 into a low-temperature, intermediate-pressure two-phase refrigerant, a liquid refrigerant, or a gas refrigerant, which then passes through the main refrigerant pipe 4 and flows into the outdoor unit 1 again. The refrigerant flowing into the outdoor unit 1 branches at the inlet of the refrigerant heat exchanger 16 into a refrigerant that flows into the refrigerant heat exchanger 16 and a refrigerant that flows into the injection pipe 18.

The refrigerant that has flowed into the refrigerant heat exchanger 16 on the side of the main refrigerant pipe 4 transfers heat to the refrigerant on the side of the injection pipe 18, which is a low-temperature, low-pressure two-phase refrigerant decompressed by the second expansion device 31 so as to be further cooled into a low-temperature, intermediate-pressure liquid refrigerant. Then, the low-temperature, intermediate-pressure liquid refrigerant further cooled in the refrigerant heat exchanger 16 flows into and is decompressed by the first expansion device 30, and then becomes a low-temperature, low-pressure gas refrigerant while removing heat in the heat source side heat exchanger 12 from the outdoor air. The low-temperature, low-pressure gas refrigerant flowing out of the heat source side heat exchanger 12 is drawn by suction into the compressor 10 again via the refrigerant flow switching device 11 and the accumulator 13.

On the other hand, the refrigerant that has flowed into the injection pipe 18 flows into and is decompressed by the second expansion device 31 into a low-temperature, low-pressure two-phase refrigerant. The low-temperature, low-pressure two-phase refrigerant then flows into the refrigerant heat exchanger 16, removes heat from the low-temperature, intermediate-pressure two-phase or liquid refrigerant, and, as a result, becomes a low-temperature, low-pressure two-phase refrigerant having a slightly high quality and having a pressure higher than the intermediate pressure of the compressor 10. The low-temperature, low-pressure two-phase refrigerant flowing out of the refrigerant heat exchanger 16 on the side of the injection pipe 18 is injected into the intermediate compression chamber in the compressor 10 via the first opening and closing device 32.

Note that the opening degree of the first expansion device 30 is set so that the first expansion device 30 is open to a nearly maximum degree in order to prevent a reduction in the pressure of the refrigerant when it is low. The opening degree of the second expansion device 31 is controlled so that the degree of superheat, which is obtained as the difference between the value of the saturation temperature corresponding to the pressure detected by the first pressure sensor 41 and the temperature detected by the first temperature sensor 43, becomes constant. The opening degree of the third expansion device 22 is set so that the third expansion device 22 is open to a nearly maximum degree in order to prevent a reduction in the pressure of the refrigerant when it is low.

[Effect of Low-Outside-Air-Temperature Heating Operation Start Mode]

For example, in a low outside air temperature environment with an outside air temperature of approximately −10 degrees C. or less, the indoor temperature is also low in correspondence with the low outside air temperature. Accordingly, the saturation temperature of the high-pressure refrigerant is lower than the indoor air temperature for approximately 5 to 15 minutes immediately after the start of an air-conditioning apparatus. Thus, even if a high-pressure refrigerant is supplied to a heat source side heat exchanger in the heating operation, the high-temperature, high-pressure gas refrigerant is not liquefied in the heat source side heat exchanger. That is, the gas refrigerant is supplied to a compressor via an injection pipe, resulting in a reduced effect of suppressing the increase in the temperature of the refrigerant discharged from the compressor.

Accordingly, in the process of increasing the rotation speed of the compressor and increasing the pressure of the refrigerant when it is high, there may arise problems such as an "abnormal increase in the temperature of the refrigerant discharged from the compressor", "deterioration of refrigerating machine oil", and "damage to the compressor caused by the deterioration of the refrigerating machine oil". In addition, if the rotation speed of the compressor is decreased to prevent such problems, the increase in the pressure of the refrigerant when it is high is delayed, and it takes a given time to ensure a sufficient heating capacity, leading to a "reduction in user comfort".

To address such inconvenience, the air-conditioning apparatus 100 executes a "low-outside-air-temperature heating operation start mode of injecting a refrigerant into the compressor 10 while reducing the temperature of a refrigerant that is discharged from the compressor 10" prior to a "low-outside-air-temperature heating operation mode of injecting a refrigerant into the compressor 10". This allows the air-conditioning apparatus 100 to suppress an increase in the temperature of the refrigerant discharged from the compressor 10 for, for example, approximately 5 to 15 minutes immediately after the start of the air-conditioning apparatus 100, and can improve the effect of injection into the compressor 10.

More specifically, the air-conditioning apparatus 100 executes, prior to execution of the low-outside-air-temperature heating operation mode, a low-outside-air-temperature heating operation start mode of causing part of the high-temperature, high-pressure gas refrigerant discharged from the compressor 10 to flow into the heat source side heat exchanger 12 via the bypass pipe 17. This allows the air-conditioning apparatus 100 to reduce the temperature of the refrigerant that flows to the suction side of the compressor 10 for, for example, approximately 5 to 15 minutes immediately after the start of the air-conditioning apparatus 100, achieving "suppression of an abnormal increase in the temperature of the refrigerant discharged from the compressor 10", "prevention of deterioration of refrigerating machine oil", and "prevention of damage to the compressor 10". Therefore, a "smooth increase in the rotation speed of the compressor 10" can be achieved.

Note that since the saturation temperature of the high-pressure refrigerant is higher than the indoor air temperature, for example, approximately 5 to 15 minutes after the start of the air-conditioning apparatus 100, the air-conditioning apparatus 100 may shift from the "low-outside-air-temperature heating operation start mode" to the "low-outside-air-temperature heating operation mode" to increase the "amount of refrigerant injected" with respect to the "total amount of circulating refrigerant".

Figure 6:
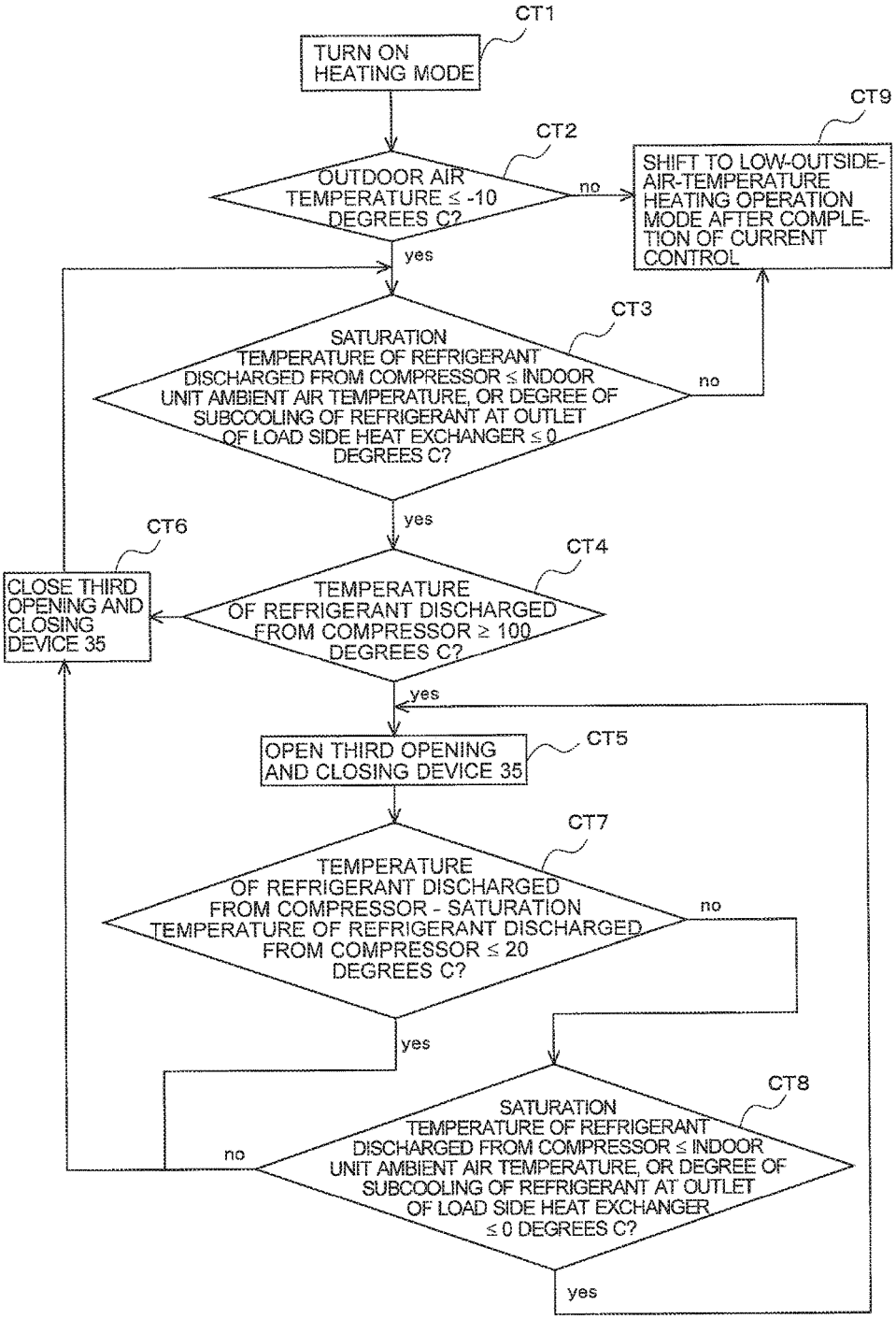
FIG. 6 is a flowchart illustrating a control operation in the low-outside-air-temperature heating operation start mode of the air-conditioning apparatus according to Embodiment 1 of the present invention.

FIG. 6 is a flowchart illustrating a control operation in the low-outside-air-temperature heating operation start mode of the air-conditioning apparatus 100 according to Embodiment 1. The operation of the controller 50 in the low-outside-air-temperature heating operation start mode will be described with reference to FIG. 6.

(CT1)

When a heating operation request is issued from the indoor unit 2, if the outside air temperature falls within a predetermined range of values (for example, 0 degrees C. to 10 degrees C.), the controller 50 executes a normal heating operation mode. If the outside air temperature is less than a predetermined value (for example, less than 0 degrees C.), the controller 50 executes a low-outside-air-temperature heating operation start mode, and proceeds to CT2.

(CT2)

The controller 50 determines whether the outdoor air temperature detected by the second temperature sensor 45 is equal to or less than a predetermined value (for example, −10 degrees C. or less). The predetermined value corresponds to a second predetermined value.

If the outdoor air temperature is equal to or less than the predetermined value, the controller 50 proceeds to CT3.

If the outdoor air temperature is higher than the predetermined value, the controller 50 proceeds to CT9, and executes the low-outside-air-temperature heating operation mode.

(CT3)

The controller 50 determines whether the condition that "the saturation temperature of the refrigerant discharged from the compressor 10, which is calculated from the pressure detected by the first pressure sensor 41, is equal to or less than the temperature detected by the sixth temperature sensor 44" or the condition that "the degree of subcooling, which is obtained as the difference between the value of the saturation temperature corresponding to the pressure detected by the first pressure sensor 41 and the temperature of the refrigerant at the outlet of the heat source side heat exchanger 12 detected by the fourth temperature sensor 46, is equal to or less than a predetermined value (for example, 0 degrees C. or less)" is satisfied.

If either of these conditions is satisfied, the controller 50 proceeds to CT4.

If neither of these conditions is satisfied, the controller 50 proceeds to CT9.

(CT4)

The controller 50 determines whether the temperature of the refrigerant discharged from the compressor 10, which is detected by the first temperature sensor 43, is equal to or greater than a predetermined value (for example, 100 degrees C. or higher). The predetermined value corresponds to a first predetermined value.

If the refrigerant temperature is equal to or greater than the predetermined value, the controller 50 proceeds to CT5.

If the refrigerant temperature is less than the predetermined value, the controller 50 proceeds to CT6.

(CT5)

The controller 50 opens the third opening and closing device 35 to cause the refrigerant from the bypass pipe 17 to flow to the suction side of the compressor 10. Thus, the temperature of the refrigerant discharged from the compressor 10 can be reduced.

(CT6)

The controller 50 closes the third opening and closing device 35.

(CT7)

The controller 50 determines whether the degree of superheat of the refrigerant discharged from the compressor 10 is equal to or less than a predetermined value (for example, 20 degrees C. or less). The degree of superheat is calculated from the difference between the temperature of the refrigerant discharged from the compressor 10, which is detected by the first temperature sensor 43, and the saturation temperature of the refrigerant discharged from the compressor 10, which is calculated from the pressure detected by the first pressure sensor 41.

If the degree of superheat is equal to or less than the predetermined value, the controller 50 proceeds to CT6.

If the degree of superheat is higher than the predetermined value, the controller 50 proceeds to CT8.

If the degree of superheat is equal to or less than the predetermined value in CT7, the controller 50 proceeds to CT6, in which it closes the third opening and closing device 35 to prevent an excessive amount of liquid refrigerant from flowing into the compressor 10. This can prevent a reduction in the density of refrigerating machine oil inside the compressor 10, and can prevent damage to the compressor 10 due to the exhaustion of the refrigerating machine oil.

(CT8)

The controller 50 performs determination similar in detail to that in CT3. Specifically, the controller 50 determines whether at least one of the conditions that "the saturation temperature of the refrigerant discharged from the compressor 10, which is calculated from the pressure detected by the first pressure sensor 41, is equal to or less than the temperature detected by the sixth temperature sensor 44" and "the degree of subcooling, which is obtained as the difference between the value of the saturation temperature corresponding to the pressure detected by the first pressure sensor 41 and the temperature of the refrigerant at the outlet of the heat source side heat exchanger 12 detected by the fourth temperature sensor 46, is equal to or less than a predetermined value (for example, 0 degrees C. or less)" is satisfied.

If at least one of these conditions is satisfied, the controller 50 returns to CT5.

If neither of these conditions is satisfied, the controller 50 proceeds to CT6.

(CT9)

The controller 50 closes the third opening and closing device 35 to end the control of the low-outside-air-temperature heating operation start mode, and then proceeds to the low-outside-air-temperature heating operation mode.

In the illustration of FIG. 6, the operation that proceeds to "the determination of CT4" after satisfying "the determination of CT2" and "the determination of CT3" has been described, by way of example. However, the embodiments herein are not limited to this operation. That is, control that proceeds to "the determination of CT4" from CT1 without performing "the determination of CT2" and "the determination of CT3" may be performed. Also in this low-outside-air-temperature heating operation start mode, an abnormal increase in the temperature of the refrigerant discharged from the compressor 10 can be suppressed to achieve the effect of preventing damage to the compressor 10.

In CT4, the temperature of the refrigerant discharged from the compressor 10 is typically set to, for example, 100 degrees C. or more. However, the embodiments herein are not limited to this example. That is, the temperature of the refrigerant discharged from the compressor 10 may be set to, for example, approximately 120 degrees C. or more.

In addition, the predetermined value of the temperature of the refrigerant discharged from the compressor 10, which is detected by the first temperature sensor 43, may be set so that the difference between the temperature of the refrigerant discharged from the compressor 10, which is detected by the first temperature sensor 43, and the saturation temperature of the refrigerant discharged from the compressor 10, which is calculated from the pressure detected by the first pressure sensor 41, is, for example, approximately 20 degrees C. or more. This can prevent an excessive amount of liquid refrigerant from flowing to the suction side of the compressor 10, while preventing the temperature of the gas refrigerant discharged from the compressor 10 from reaching, in the process of speeding up the compressor 10, that at which damage to the compressor 10 can reliably be prevented, and can also prevent damage to the compressor 10 due to the exhaustion of the refrigerating machine oil in the compressor 10.

(Size Selection Method 1 for Third Opening and Closing Device 35 According to Embodiment 1)

Next, a description will be given of a method for appropriately selecting the size of the third opening and closing device 35 so as to prevent an excessive amount of liquid refrigerant from flowing to the suction side of the compressor 10 while reliably lowering the temperature of the refrigerant discharged from the compressor 10.

It is assumed that the flow rate of a low-temperature, low-pressure gas refrigerant that flows to the suction side of the compressor 10 from the accumulator 13 is represented by $Gr_1$ (kg/h), and enthalpy is represented by $h_1$ (kJ/kg). It is also assumed that the flow rate of a low-temperature, low-pressure liquid refrigerant that flows into the suction pipe of the compressor 10 from the heat source side heat exchanger 12 via the bypass pipe 17 is represented by $Gr_2$ (kg/h), and enthalpy is represented by $h_2$ (kJ/kg). It is furthermore assumed that the total flow rate of the refrigerant obtained after the refrigerants merge at the suction side of the compressor 10 is represented by Gr ($=Gr_1+Gr_2$) (kg/h), and enthalpy after merging is represented by h (kJ/kg). In this case, the energy conservation equation given by Expression (1) holds true.

[Math. 1]

$$Gr_1h_1+Gr_2h_2=Grh \tag{1}$$

The enthalpy h (kJ/kg) after merging, which is calculated using Expression (1), is less than the enthalpy $h_1$ (kJ/kg) of the low-temperature, low-pressure gas refrigerant flowing to the suction side of the compressor 10 from the accumulator 13, resulting in the discharge temperature of the compressed refrigerant being lower than that when the liquid refrigerant from the bypass pipe 17 does not merge.

Note that the size of the third opening and closing device 35 is selected on the following assumptions (to be also referred to as the assumptions for size selection method A hereinafter): it is assumed that an equivalent adiabatic efficiency and an equivalent displacement are used to compress a refrigerant to a predetermined pressure in the case of "'compressing the refrigerant having the enthalpy $h_1$ (kJ/kg) that is supplied to the suction side of the compressor 10 to a predetermined pressure' while 'the third opening and closing device 35 is closed so as to block the refrigerant flowing to the suction side of the compressor 10 from the bypass pipe 17'" and in the case of "after 'refrigerants merge at the suction side of the compressor 10 and the enthalpy becomes h (kJ/kg)', 'compressing the refrigerant having the enthalpy h (kJ/kg) to a predetermined pressure' while 'the third opening and closing device 35 is open so as to cause the refrigerant to flow into the suction pipe of the compressor 10 from the bypass pipe 17'".

Then, the value of $Gr_2$ (kg/h) in Expression (1) is changed arbitrarily, and the value of $Gr_2$ (kg/h), which is used to "reduce the temperature of the gas refrigerant", is calculated so that the temperature of the refrigerant discharged from the compressor 10 is "higher than the saturation temperature of the refrigerant discharged from the compressor 10 by approximately 10 degrees C. (corresponding to a third predetermined value) or more". Then, the size of the third opening and closing device 35 is selected using the calculated $Gr_2$ (kg/h) and using the difference between the pressure of the refrigerant discharged from the compressor 10 and that of the refrigerant on the suction side of the compressor 10 in accordance with Expression (2) as follows.

[Math. 2]

$$Cv = 1.17Q\sqrt{\frac{\gamma}{P_1 - P_2}} \tag{2}$$

That is, the size of the third opening and closing device 35 is desirably determined so that "'the flow coefficient (Cv value) of the third opening and closing device 35' is approximately 0.01 or less when 'the displacement of the compressor 10' is 15 $m^3$/h (inclusive) to 30 $m^3$/h (exclusive)", "'the flow coefficient (Cv value) of the third opening and closing device 35' is approximately 0.02 or less' when 'the displacement of the compressor 10' is 30 $m^3$/h (inclusive) to 40 $m^3$/h (exclusive)", and "'the flow coefficient (Cv value) of the third opening and closing device 35' is approximately 0.03 or less' when 'the displacement of the compressor 10' is 40 $m^3$/h (inclusive) to 60 $m^3$/h (exclusive)".

Note that in Expression (2), Q ($m^3$/h) represents the flow rate of the refrigerant flowing through the bypass pipe 17, $\gamma$(−) represents the specific gravity, $P_1$ (kgf/$cm^2$ abs) represents the pressure of the refrigerant discharged from the compressor 10, and $P_2$ (kgf/$cm^2$ abs) represents the refrigerant pressure inside the suction pipe of the compressor 10. The Cv value represents the capacity of the third opening and closing device 35. The Cv value, when the refrigerant flowing into the third opening and closing device 35 is a liquid refrigerant, is computed from Expression (2).

For details of Expression (2), see Valve Course Compilation Committee, "Shoho to Jitsuyo no Barubu Kouza (Course in Basics and Applications of Valve Technology), Revised Edition", published by "Sakutaro Kobayashi", "Japan Industrial Publishing Co., Ltd.", 4th Edition, Jun. 30, 1998.

(Size Selection Method 2 for Third Opening and Closing Device 35 According to Embodiment 1)

In (Size Selection Method 1 for Third Opening and Closing Device 35 according to Embodiment 1), a size is obtained on the "assumptions for size selection method A", described above, with little concern for the reduction in pressure due to friction loss in the bypass pipe 17. In (Size Selection Method 2 for Third Opening and Closing Device 35 according to Embodiment 1), the size of the third opening and closing device 35 may be selected using Expressions (3) and (4) (to be described later) by additionally taking into account the friction loss that varies depending on the pipe inside diameter and length of the bypass pipe 17.

Specifically, if the reduction in pressure due to friction loss in the bypass pipe 17 is as negligibly small as, for example, approximately 0.001 (MPa) or less, the size of the third opening and closing device 35 may fall within the range of Cv values described above in (Size Selection Method 1 for Third Opening and Closing Device 35 according to Embodiment 1). On the other hand, if the reduction in pressure due to friction loss in a part or the whole of the bypass pipe 17 is large, the amount of liquid refrigerant flowing into the suction pipe of the compressor 10 from the bypass pipe 17 is small, and the effect of suppressing an abnormal increase in the temperature of the gas refrigerant discharged from the compressor 10 is poor. Accordingly, (Size Selection Method 2 for Third Opening and Closing Device 35 according to Embodiment 1) in which the size of the third opening and closing device 35 is selected to be large correspondingly is preferably employed.

In (Size Selection Method 2 for Third Opening and Closing Device 35 according to Embodiment 1), the sum of "the pressure loss in the bypass pipe 17 and the pressure loss in the third opening and closing device 35" is set substantially equal to the difference between "the pressure of the gas refrigerant discharged from the compressor 10 and that of the refrigerant on the suction side of the compressor 10". Details will be described hereinafter.

For example, based on the particulars given in (Size Selection Method 1 for Third Opening and Closing Device 35 according to Embodiment 1), the liquid refrigerant flow rate $Gr_2$ (kg/h) is calculated to be approximately 44 (kg/h), which is satisfactory in terms of "reducing the temperature of the gas refrigerant" so that the temperature of the refrigerant discharged from the compressor 10 is higher than "the saturation temperature of the refrigerant discharged from the compressor 10 by approximately 10 degrees C. or more" when the following conditions (A) and (B) are satisfied.

The condition (A) is that "a high-pressure liquid refrigerant at 1.2 (MPa abs) flows into a suction pipe at 0.2 MPa·abs via the bypass pipe 17".

The condition (B) is that "a gas refrigerant is discharged from the compressor 10 at a displacement equivalent to a force of 10 horsepower (approximately 30 $m^3$/h)".

It is assumed, for example, that a pipe having an inside diameter of 1.2 (mm) and a length of 1263 (mm) is connected to a part of the bypass pipe 17 between the third opening and closing device 35 and a suction unit of the compressor 10 and that the pressure loss in the third opening and closing device 35 is represented by α. In this case, if a liquid refrigerant having a flow rate $Gr_2$ (kg/h) of approximately 44 (kg/h) flows, the "pressure loss ($P_1$−$P_2$ in Expression (3))" in the bypass pipe 17 is calculated to be approximately 0.999 (MPa abs) in accordance with Expressions (3) and (4) as follows.

[Math. 3]

$$\frac{(P_1 - P_2)}{\rho g} = \lambda \frac{L}{d} \frac{V^2}{2\,g} \tag{3}$$

[Math. 4]

$$\lambda = 0.3164 \times \frac{1}{Re^{\frac{1}{4}}} \tag{4}$$

That is, the pressure loss α in the third opening and closing device 35 is calculated to be 0.001 (MPa abs) from the difference between 1.0 MPa, which is the difference between "the pressure of the gas refrigerant discharged from the compressor 10 and that of the refrigerant on the suction side of the compressor 10", and 0.999 (MPa abs), which is the "pressure loss ($P_1$−$P_2$ in Expression (3))" in a part of the bypass pipe 17. Then, calculating Q from $Gr_2$, that is, 44 (kg/h), and substituting α (corresponding to $P_1$−$P_2$ in Expression (2)), that is 0.001, into Expression (2) yields approximately 0.47 or more as the desired Cv value of the third opening and closing device 35.

As described above, (Size Selection Method 2 for Third Opening and Closing Device 35 according to Embodiment 1) can reliably set the sum of "the pressure loss in the bypass pipe 17 and the pressure loss in the third opening and closing device 35" to be substantially equal to the difference between "the pressure of the gas refrigerant discharged from the compressor 10 and that of the refrigerant on the suction side of the compressor 10" to ensure "a liquid refrigerant in an amount sufficient to compensate for the friction loss in the bypass pipe 17 so that the effect of suppressing the increase in the temperature of the refrigerant discharged from the compressor 10" can be achieved.

(Modification of Size Selection Method 2 for Third Opening and Closing Device 35 According to Embodiment 1)

In (Size Selection Method 2 for Third Opening and Closing Device 35 according to Embodiment 1), a predetermined pipe is prepared as the bypass pipe 17 and the "Cv value of the third opening and closing device 35" is calculated, by way of example. However, the embodiments herein are not limited to this example.

Specifically, the "Cv value of the third opening and closing device 35", the "pipe inside diameter of the bypass pipe 17", and the "length of the bypass pipe 17" may be determined so that the sum of "the pressure loss in the bypass pipe 17 and the pressure loss in the third opening and closing device 35" is substantially equal to the difference between the "pressure of the gas refrigerant discharged from the compressor 10 and that of the refrigerant on the suction side of the compressor 10".

Note that Expression (3) is the well-known Darcy-Weisbach equation for pressure loss due to pipe friction of a pipe. In Expression (3), L (m) represents the length of the bypass pipe 17, d (m) represents the inside diameter of the bypass pipe 17, $P_1$ (Pa·abs) represents the pressure of the refrigerant discharged from the compressor 10, $P_2$ (Pa·abs) represents the refrigerant pressure inside the suction pipe of the compressor 10, g ($m/s^2$) represents the gravitational acceleration, ρ represents the density ($kg/m^3$) of a liquid refrigerant flowing into the bypass pipe 17, and v (m/s) represents the speed of a liquid refrigerant flowing into the bypass pipe 17. In addition, λ represents a pipe friction loss coefficient. Expression (4) is the well-known Blasius equation for a pipe friction loss coefficient, and Re is the Reynolds number.

[Advantages of Air-Conditioning Apparatus 100 According to Embodiment 1]

The air-conditioning apparatus 100 according to Embodiment 1 is capable of executing the low-outside-air-temperature heating operation start mode, thus enabling a reduction in the temperature of the refrigerant flowing to the suction side of the compressor 10 for, for example, approximately 5 to 15 minutes immediately after the start of the air-conditioning apparatus 100, achieving "suppression of an abnormal increase in the temperature of the refrigerant discharged from the compressor 10", "prevention of deterioration of refrigerating machine oil", and "prevention of damage to the compressor 10". The reliability of the air-conditioning apparatus 100 can be improved.

The air-conditioning apparatus 100 according to Embodiment 1 can achieve "suppression of an abnormal increase in the temperature of the refrigerant discharged from the compressor 10", "prevention of deterioration of refrigerating machine oil", and "prevention of damage to the compressor 10", and can thus "smoothly increase the rotation speed of the compressor 10", preventing prolongation of the time taken to ensure a sufficient heating capacity. Accordingly, the air-conditioning apparatus 100 according to Embodiment 1 can suppress a "reduction in user comfort".

Embodiment 2

Figure 7:
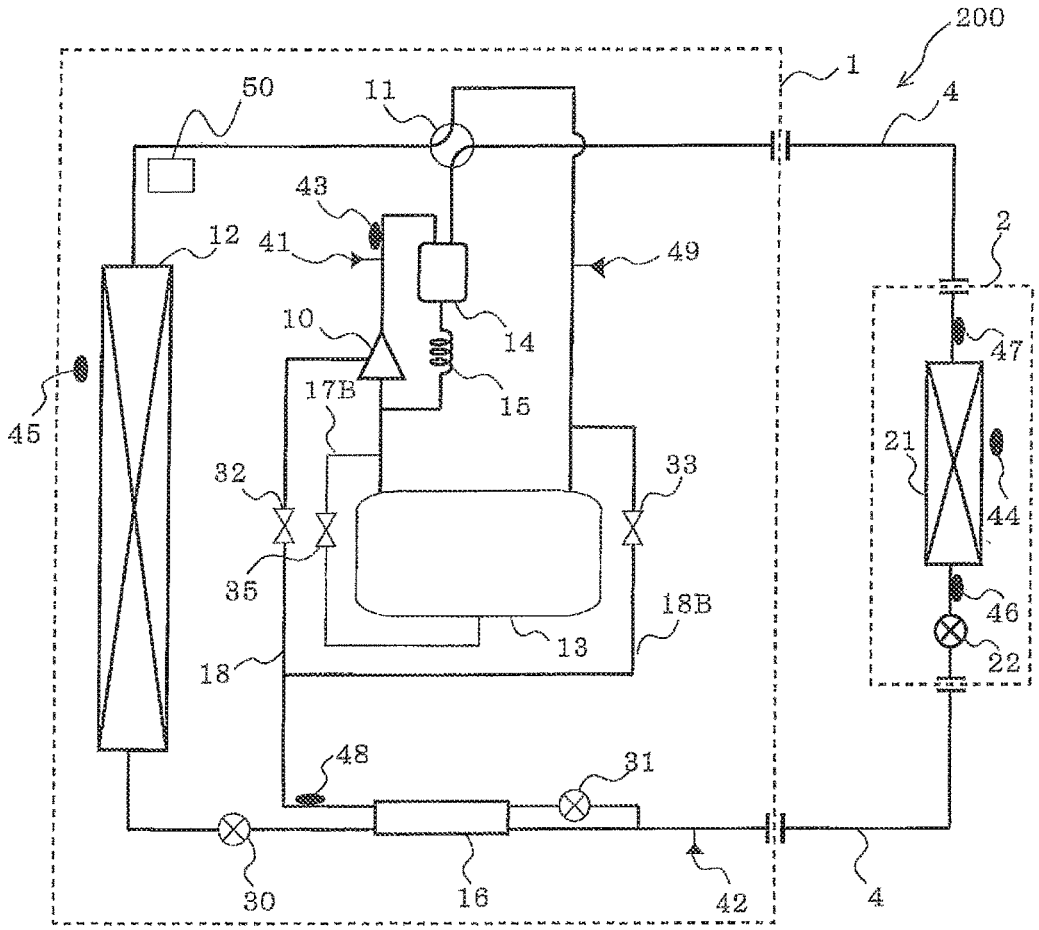
FIG. 7 is a schematic circuit configuration diagram illustrating an example of the circuit configuration of an air-conditioning apparatus according to Embodiment 2 of the present invention.

FIG. 7 is a schematic circuit configuration diagram illustrating an example of the circuit configuration of an air-conditioning apparatus (to be referred to as an air-conditioning apparatus 200 hereinafter) according to Embodiment 2. In Embodiment 2, the difference from Embodiment 1, described above, will be mainly described, and the same reference numerals denote the same portions as those in Embodiment 1.

The configuration of the air-conditioning apparatus 200 illustrated in FIG. 7 is different from that of the air-conditioning apparatus 100 in terms of the configuration of the outdoor unit 1. Specifically, in the air-conditioning apparatus 200, the outdoor unit 1 has a connecting pipe 17B connected to a suction unit of the compressor 10 from the bottom of the accumulator 13 via the third opening and closing device 35. More specifically, the connecting pipe 17B has its one side connected to the bottom of the accumulator 13, and its other side connected to a portion of the main refrigerant pipe 4 between the accumulator 13 and the suction side of the compressor 10. Unlike the bypass pipe 17, the connecting pipe 17B is installed in the outdoor unit 1 so as not to extend through the heat source side heat exchanger 12.

The air-conditioning apparatus 200 is configured to supply the liquid refrigerant accumulated in the accumulator 13 to the suction side of the compressor 10 via the connecting pipe 17B and the third opening and closing device 35. That is, the air-conditioning apparatus 100 is configured to cause the refrigerant discharged from the compressor 10 to exchange heat in the heat source side heat exchanger 12 to produce a liquid refrigerant which is then supplied to the suction side of the compressor 10, whereas the air-conditioning apparatus 200 is configured to supply the liquid refrigerant accumulated in the accumulator 13 to the suction side of the compressor 10. Other operations and control of the air-conditioning apparatus 200 are similar to those of the air-conditioning apparatus 100.

Next, a description will be given of a method for selecting the size of the third opening and closing device 35 according to Embodiment 2. In the air-conditioning apparatus 200, the difference between the refrigerant pressures at the inlet and outlet of the third opening and closing device 35 is smaller than that in the air-conditioning apparatus 100. Thus, the size of the third opening and closing device 35 needs to be selected to be larger than that in the air-conditioning apparatus 100. The selection method in Embodiment 2 is similar to that in Embodiment 1. The result in Embodiment 2 corresponding to that in Embodiment 1 described above (Size Selection Method 1 for Third Opening and Closing Device 35 according to Embodiment 2) is as follows.

(Size Selection Method 1 for Third Opening and Closing Device 35 According to Embodiment 2).

The size of the third opening and closing device 35 is desirably determined so that "'the flow coefficient (Cv value) of the third opening and closing device 35' is approximately 0.15 or less when 'the displacement of the compressor 10' is 15 $m^3/h$ (inclusive) to 30 $m^3/h$ (exclusive)", "'the flow coefficient (Cv value) of the third opening and closing device 35' is approximately 0.20 or less' when 'the displacement of the compressor 10' is 30 $m^3/h$ (inclusive) to 40 $m^3/h$ (exclusive)", and "'the flow coefficient (Cv value) of the third opening and closing device 35" is approximately 0.35 or less' when 'the displacement of the compressor 10' is 40 $m^3/h$ (inclusive) to 60 $m^3/h$ (exclusive)".

(Size Selection Method 2 for Third Opening and Closing Device 35 According to Embodiment 2).

In (Size Selection Method 2 for Third Opening and Closing Device 35 according to Embodiment 2), the "Cv value of the third opening and closing device 35", the "pipe inside diameter of the connecting pipe 17B", and the "length of the connecting pipe 17B" are determined so that the sum of "the pressure loss in the connecting pipe 17B and the pressure loss in the third opening and closing device 35" is substantially equal to the "difference between the pressure inside the accumulator 13 and the pressure on the suction side of the compressor 10".

The calculation method is similar to that in (Size Selection Method 2 for Third Opening and Closing Device 35 according to Embodiment 1), and a description thereof will thus be omitted.

[Advantages of Air-Conditioning Apparatus 200 According to Embodiment 2]

The air-conditioning apparatus 200 according to Embodiment 2 also has advantages similar to those of the air-conditioning apparatus 100 according to Embodiment 1.

Embodiment 3

Figure 8:
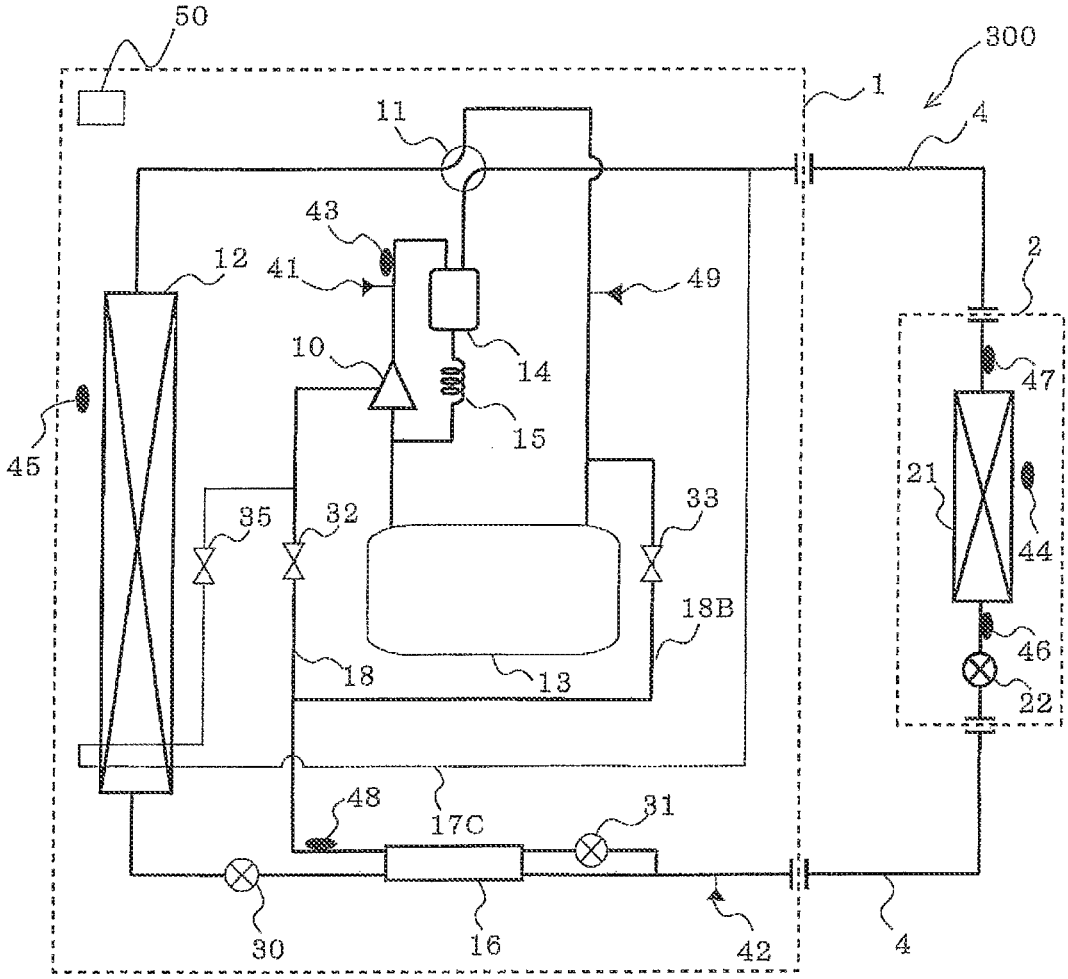
FIG. 8 is a schematic circuit configuration diagram illustrating an example of the circuit configuration of an air-conditioning apparatus according to Embodiment 3 of the present invention.

FIG. 8 is a schematic circuit configuration diagram illustrating an example of the circuit configuration of an air-conditioning apparatus (to be referred to as an air-conditioning apparatus 300 hereinafter) according to Embodiment 3. In Embodiment 3, the difference from Embodiments 1 and 2, described above, will be mainly described, and the same reference numerals denote the same portions as those in Embodiments 1 and 2.

The configuration of the air-conditioning apparatus 300 illustrated in FIG. 8 is different from those of the air-conditioning apparatuses 100 and 200 in terms of the configuration of the outdoor unit 1. Specifically, in the air-conditioning apparatus 300, the outdoor unit 1 has a bypass pipe 17C connected to the injection pipe 18. More specifically, the bypass pipe 17C has its one side connected to the main refrigerant pipe 4 connecting the refrigerant flow switching device 11 and the indoor unit 2, and its other side connected to a portion of the injection pipe 18 between the first opening and closing device 32 and the compressor 10. The bypass pipe 17C is provided to extend through the heat source side heat exchanger 12 so as to allow the refrigerant flowing through the heat source side heat exchanger 12 to exchange heat, similarly to the bypass pipe 17.

In the air-conditioning apparatus 300, a gas refrigerant which is discharged from the compressor 10 and flows into the bypass pipe 17C is transformed into a liquid refrigerant in the heat source side heat exchanger 12, which then flows into the injection pipe 18 via the bypass pipe 17C and the third opening and closing device 35. The refrigerant flowing into the injection pipe 18 from the bypass pipe 17C merges with the refrigerant flowing through the injection pipe 18, and the merged refrigerant is injected into the intermediate compression chamber in the compressor 10. Other operations and control of the air-conditioning apparatus 300 are similar to those of the air-conditioning apparatus 100.

(Size Selection Method 1 for Third Opening and Closing Device 35 According to Embodiment 3).

In Embodiment 3, instead of Expression (1) in Embodiment 1, Expression (5) to be presented below is used. Specifically, it is assumed that the enthalpy at which the low-temperature, low-pressure gas refrigerant flowing into the suction pipe of the compressor 10 from the accumulator 13 is compressed in the intermediate compression chamber in the compressor 10 is represented by $h_3$ (kJ/kg), and the flow rate is represented by $Gr_3$ (kg/h). It is also assumed that the flow rate of the low-temperature, intermediate-pressure refrigerant flowing into the intermediate compression chamber in the compressor 10 from the heat source side heat exchanger 12 via the third opening and closing device 35, the bypass pipe 17C, and the injection pipe 18 is represented by $Gr_4$ (kg/h), and the enthalpy is represented by $h_4$ (kJ/kg). It is furthermore assumed that the enthalpy after the respective refrigerants merge in the intermediate compression chamber in the compressor 10 is represented by $h_5$ (kJ/kg). In this case, the energy conservation equation given in Expression (5) holds true.

[Math. 5]

$$Gr_3h_3+Gr_4h_4=(Gr_3+Gr_4)h_5 \quad (5)$$

Note that in the air-conditioning apparatus 300, the difference between the refrigerant pressures at the inlet and outlet of the third opening and closing device 35 is smaller than that in the air-conditioning apparatus 100. Thus, the size of the third opening and closing device 35 needs to be selected to be larger than that in the air-conditioning apparatus 100. The size of the third opening and closing device 35 in the air-conditioning apparatus 300 is selected using a technique similar to that in the air-conditioning apparatus 100.

The enthalpy $h_5$ (kJ/kg) after merging, which is calculated using Expression (5), is less than the enthalpy $h_3$ (kJ/kg) of the low-temperature, low-pressure gas refrigerant flowing to the suction side of the compressor 10 from the accumulator 13. Hence, the discharge temperature of the compressed refrigerant in this case is lower than that when the liquid refrigerant from the bypass pipe 17C does not merge.

Note that the size of the third opening and closing device 35 is selected on the following assumptions (to be also referred to as the assumptions for size selection method B hereinafter): it is assumed that an equivalent adiabatic efficiency and an equivalent displacement are used to compress a refrigerant to a predetermined pressure in the case of "'compressing the refrigerant having the enthalpy $h_3$ (kJ/kg) that is supplied to the suction side of the compressor 10 to a predetermined pressure' while 'the third opening and closing device 35 is closed so as to block the refrigerant flowing into the intermediate compression chamber in the compressor 10 from the bypass pipe 17C'" and in the case of "after 'refrigerants merge in the intermediate compression chamber and the enthalpy becomes $h_5$ (kJ/kg)', 'compressing the refrigerant having the enthalpy $h_5$ (kJ/kg) to a predetermined pressure' while 'the third opening and closing device 35 is open so as to cause the refrigerant to flow into the intermediate compression chamber in the compressor 10 from the bypass pipe 17C'".

Then, the value of $Gr_4$ (kg/h) in Expression (5) is changed arbitrarily, and the value of $Gr_4$ (kg/h), which is used to "reduce the temperature of the gas refrigerant", is calculated so that the temperature of the refrigerant discharged from the compressor 10 is "higher than the saturation temperature of the refrigerant discharged from the compressor 10 by approximately 10 degrees C. or more". Then, the size of the third opening and closing device 35 is selected in accordance with Expression (2), described above, using the calculated $Gr_4$ (kg/h) and using the difference between the pressure of the refrigerant discharged from the compressor 10 and that of the refrigerant on the suction side of the compressor 10 as follows.

The size of the third opening and closing device 35 is desirably determined so that "'the flow coefficient (Cv value) of the third opening and closing device 35" is approximately 0.02 or less when 'the displacement of the compressor 10' is 15 $m^3$/h (inclusive) to 30 $m^3$/h (exclusive)", "'the flow coefficient (Cv value) of the third opening and closing device 35' is approximately 0.03 or less' when 'the displacement of the compressor 10' is 30 $m^3$/h (inclusive) to 40 $m^3$/h (exclusive)", and "'the flow coefficient (Cv value) of the third opening and closing device 35' is approximately 0.05 or less' when 'the displacement of the compressor 10' is 40 $m^3$/h (inclusive) to 60 $m^3$/h (exclusive)".

(Size Selection Method 2 for Third Opening and Closing Device 35 According to Embodiment 3).

In (Size Selection Method 1 according to Embodiment 3), a size is selected on the "assumptions B for size selection method", described above, with little concern for the reduction in pressure due to friction loss in the bypass pipe 17C. In (Size Selection Method 2 for Third Opening and Closing Device 35 according to Embodiment 3), the size of the third opening and closing device 35 may be selected using Expressions (3) and (4), described above, by additionally taking into account the friction loss that may vary in accordance with the pipe inside diameter and length of the bypass pipe 17C.

Specifically, if the reduction in pressure due to friction loss in the bypass pipe 17C is as negligibly small as, for example, approximately 0.001 (MPa) or less, the size of the third opening and closing device 35 may fall within the range of Cv values described above in (Size Selection Method 1). On the other hand, if the reduction in pressure due to friction loss in a part or the whole of the bypass pipe 17C is large, the amount of liquid refrigerant flowing into the intermediate compression chamber in the compressor 10 from the bypass pipe 17C is small, and the effect of suppressing an abnormal increase in the temperature of the gas refrigerant discharged from the compressor 10 is poor. Accordingly, (Size Selection Method 2) in which the size of the third opening and closing device 35 is selected to be large correspondingly is preferably employed.

In (Size Selection Method 2 for Third Opening and Closing Device 35 according to Embodiment 3), the sum of "the pressure loss in the bypass pipe 17C and the pressure loss in the third opening and closing device 35" is set substantially equal to the difference between "the pressure of the gas refrigerant discharged from the compressor 10 and that of the refrigerant in the intermediate compression chamber in the compressor 10". Details will be described hereinafter.

For example, based on the particulars given in (Size Selection Method 1 according to Embodiment 3), the liquid refrigerant flow rate $Gr_4$ (kg/h) is calculated to be approximately 60 (kg/h), which is satisfactory in terms of "reducing the temperature of the gas refrigerant" so that the temperature of the refrigerant discharged from the compressor 10 is "higher than the saturation temperature of the refrigerant discharged from the compressor 10 by approximately 10 degrees C. or more" when the following conditions (C) and (D) are satisfied.

The condition (C) is that "a high-pressure liquid refrigerant at 1.2 (MPa abs) flows into the intermediate compression chamber in the compressor 10 at 0.5 (MPa abs) via the bypass pipe 17C".

The condition (D) is that "a gas refrigerant is discharged from the compressor 10 at a displacement equivalent to a force of 10 horsepower (approximately 30 $m^3$/h)".

It is assumed, for example, that a pipe having an inside diameter of 1.2 (mm) and a length of 512 (mm) is connected to a part of the bypass pipe 17C between the third opening and closing device 35 and the intermediate compression chamber in the compressor 10 and that the pressure loss in the third opening and closing device 35 is represented by β. In this case, if a liquid refrigerant having a flow rate $Gr_4$ (kg/h) of approximately 60 (kg/h) flows, the "pressure loss ($P_1$−$P_2$ in Expression (3))" in the bypass pipe 17C is equal to approximately 0.699 (MPa abs), as can be seen from Expressions (3) and (4) presented above.

That is, the pressure loss β in the third opening and closing device 35 is calculated to be 0.001 (MPa abs) from the difference between 0.7 (MPa abs), which is the difference between "the pressure of the gas refrigerant discharged from the compressor 10 and that of the refrigerant in the intermediate compression chamber in the compressor 10", and 0.699 (MPa abs), which is the "pressure loss ($P_1$−$P_2$ in Expression (3))" in a part of the bypass pipe 17C. Then, calculating Q from $Gr_4$, that is, 60 (kg/h), and substituting β (corresponding to $P_1$−$P_2$ in Expression (2)), that is, 0.001, into Expression (2) yields approximately 0.64 or more as the desired Cv value of the third opening and closing device 35.

(Modification of Size Selection Method 2 for Third Opening and Closing Device 35 According to Embodiment 3)

In (Size Selection Method 2 for Third Opening and Closing Device 35 according to Embodiment 3), a predetermined pipe is prepared as the bypass pipe 17C and the "Cv value of the third opening and closing device 35" is calculated, by way of example. However, the embodiments herein are not limited to this example.

Specifically, the "Cv value of the third opening and closing device 35", the "pipe inside diameter of the bypass pipe 17C", and the "length of the bypass pipe 17C" may be determined so that the sum of "the pressure loss in the bypass pipe 17C and the pressure loss in the third opening and closing device 35" is substantially equal to the difference between the "pressure of the gas refrigerant discharged from the compressor 10 and that of the refrigerant in the intermediate compression chamber in the compressor 10".

[Advantages of Air-Conditioning Apparatus 300 According to Embodiment 3]

The air-conditioning apparatus 300 according to Embodiment 3 also has advantages similar to the air-conditioning apparatus 100 according to Embodiment 1.

[Refrigerant]

In Embodiments 1 to 3, examples of the refrigerant circulating in the refrigeration cycle include HFO1234yf, HFO1234ze(E), R32, HC, a refrigerant mixture of R32 and HFO1234yf, and a refrigerant that employs a refrigerant mixture containing at least one of the refrigerants described above, which can be used as a heat source side refrigerant. HFO1234ze has two geometric isomers, a trans form in which two substituents, namely F and $CF_3$ are diagonally opposite to each other across the double bond, and a cis form in which two substituents, namely F and $CF_3$ are on the same side of the double bond. HFO1234ze(E) in Embodiments 1 to 3 is in the trans form. The IUPAC name of HFO1234ze(E) is trans-1,3,3,3-tetrafluoro-1-propene.

[Third Opening and Closing Device]

The third opening and closing device 35 of Embodiments 1 to 3 is implemented using a solenoid valve in the aforementioned example. As an alternative to a solenoid valve, a valve having a variable opening degree, such as an electronic expansion valve, can also be used as an opening and closing valve.

As described above, in Embodiments 1 to 3, in a low-outside-air-temperature heating operation start mode, it is possible to suppress an abnormal increase in the temperature of the high-temperature, high-pressure gas refrigerant discharged from the compressor 10, improve the reliability of resistance of refrigerating machine oil to deterioration or resistance of the compressor 10 to damage, smoothly speed up the compressor 10, and reduce the time taken to ensure a sufficient heating capacity under a low outside air temperature condition.

Furthermore, in general, the heat source side heat exchanger 12 and the use side heat exchanger 21 are each provided with a fan, which usually blows air to promote condensation or evaporation of the refrigerant. However, the embodiments herein are not limited to this configuration. For example, a panel heater or the like that utilizes radiation can be used as the use side heat exchanger 21, and the heat source side heat exchanger 12 may be of a water-cooled type in which heat is transferred using water or antifreeze. That is, the heat source side heat exchanger 12 and the use side heat exchanger 21 can be of any type configured to transfer heat or remove heat.

In the foregoing example of the circuit configuration of Embodiments 1 to 3, a refrigerant flows directly into the use side heat exchanger 21 installed in the indoor unit 2 to cool or heat the indoor air. However, the embodiments herein are not limited to this configuration. A circuit configuration may also be used in which a refrigerant generated in the outdoor unit 1 exchanges heating energy or cooling energy with a heat medium such as water or antifreeze via an intermediate heat exchanger such as a double-pipe or plate-type heat exchanger, and the heat medium such as water or antifreeze is cooled or heated, and flows into the use side heat exchanger 21 via heat medium conveying means such as a pump so as to cool or heat the indoor air.

The invention claimed is:

1. An air-conditioning apparatus having a refrigeration cycle in which a compressor, a refrigerant flow switching device, a heat source side heat exchanger, a use side expansion device, and a use side heat exchanger are connected to one another using a refrigerant pipe, the air-conditioning apparatus comprising:

an injection pipe having one side connected to an injection port of the compressor, and the other side connected to the refrigerant pipe between the use side expansion device and the heat source side heat exchanger, the injection pipe being configured to inject a refrigerant during a compression operation of the compressor;

a refrigerant heat exchanger configured to exchange heat between the refrigerant, upon flowing through the refrigerant pipe in the refrigeration cycle, and the refrigerant, upon flowing through the injection pipe;

an accumulator having one side connected to a suction side of the compressor, and the other side connected to the refrigerant flow switching device, the accumulator being configured to store a liquid refrigerant;

a connecting pipe having one side connected to the suction side of the compressor, and the other side connected to a bottom of the accumulator; and a controller, the controller is configured to responsive to a request for a heating operation in which the use side heat exchanger functions as a condenser, determine whether outside air is below a predetermined low temperature, when the outside is determined to be below the predetermined low temperature, execute a low-outside-air-temperature heating operation start mode that controls the refrigerant flow switching device and the compressor so that, while the refrigerant, as discharged from the compressor, flows into the use side heat exchanger, the refrigerant is supplied to the injection port of the compressor via the injection pipe and a part of the refrigerant, as accumulated in the accumulator, is supplied to the compressor via the connecting pipe, and thereafter execute a low-outside-air-temperature heating operation mode that controls the refrigerant flow switching device and the compressor so that the refrigerant, as discharged from the compressor, is supplied to the injection port of the compressor via the injection pipe while flowing into the use side heat exchanger.

2. The air-conditioning apparatus of claim 1, further comprising:

an opening and closing device provided to the connecting pipe and capable of switching between opening and closing of a passage in the connecting pipe; and a first temperature sensor configured to detect a temperature of the refrigerant on a discharge side of the compressor; and wherein the controller is further configured to switch the opening and closing device in accordance with a detection result obtained by the first temperature sensor, and wherein the controller is further configured to open the opening and closing device and to supply to the connecting pipe the part of the refrigerant accumulated in the accumulator, when the detection result obtained by the first temperature sensor is not less than a preset first predetermined value.

3. The air-conditioning apparatus of claim 2, further comprising:

an outdoor unit including at least the compressor and the heat source side heat exchanger;

an indoor unit including at least the use side heat exchanger;

a second temperature sensor configured to detect an ambient air temperature of the outdoor unit;

a third temperature sensor configured to detect a temperature of air drawn by suction into the indoor unit; and a pressure sensor configured to detect a pressure of the refrigerant on the discharge side of the compressor, wherein in the low-outside-air-temperature heating operation start mode, the controller is configured to open the opening and closing device and to supply to the connecting pipe the part of the refrigerant accumulated in the accumulator, when a detection result obtained by the second temperature sensor is not more than a preset second predetermined value, a refrigerant saturation temperature calculated from a detection result obtained by the pressure sensor is lower than a detection result obtained by the third temperature sensor, and the detection result obtained by the first temperature sensor is not less than the preset first predetermined value.

4. The air-conditioning apparatus of claim 3, wherein the controller is configured to close the opening and closing device, and to shift from the low-outside-air-temperature heating operation start mode to the low-outside-air-temperature heating operation mode when the detection result obtained by the second temperature sensor is greater than the preset second predetermined value or when the detection result obtained by the second temperature sensor is not more than the preset second predetermined value and the refrigerant saturation temperature calculated from the detection result obtained by the pressure sensor is higher than the detection result obtained by the third temperature sensor.

5. The air-conditioning apparatus of claim 2, wherein the controller is configured to control an opening degree of the opening and closing device to adjust a flow rate of refrigerant flowing in the connecting pipe so that the detection result obtained by the first temperature sensor is higher than a saturation temperature of the refrigerant discharged from the compressor by at least a third predetermined value.

6. The air-conditioning apparatus of claim 5, wherein a capacity of the opening and closing device, an inside diameter of the connecting pipe, and a length of the connecting pipe are set so that a sum of a drop in refrigerant pressure caused by a stream of refrigerant having the refrigerant flow rate through the opening and closing device and a drop in refrigerant pressure caused by a stream of refrigerant having the refrigerant flow rate through the connecting pipe is equal to a differential pressure that is a difference between a pressure of the refrigerant inside the accumulator and a pressure of the refrigerant on a suction side of the compressor or a pressure of the refrigerant inside the injection port.

7. The air-conditioning apparatus of claim 6, wherein in a case where the third predetermined value is 10 degrees C., when a capacity of the opening and closing device, which is calculated from the differential pressure and the refrigerant flow rate, is defined as a Cv value, and a total amount of refrigerant that flows from the discharge side of the compressor is defined as a displacement, the Cv value is not more than 0.15 when the displacement is $15m^3/h$, inclusive, to $30m^3/h$, exclusive, the Cv value is not more than 0.20 when the displacement is $30m^3/h$, inclusive, to $40m^3/h$, exclusive, and the Cv value is not more than 0.35 when the displacement is $40m^3/h$, inclusive, to $60m^3/h$, exclusive.

8. The air-conditioning apparatus of claim 1, wherein the refrigerant, upon circulating in the refrigeration cycle, is one of HFO1234yf, HFO1234ze(E), R32, HC, a refrigerant mixture of R32 and HFO1234yf, and a refrigerant mixture including at least one of the foregoing.

* * * * *